US010463201B2

(12) United States Patent
Acers

(10) Patent No.: US 10,463,201 B2
(45) Date of Patent: Nov. 5, 2019

(54) SHOWER RELATED APPARATUS

(71) Applicant: Roger Acers, Loveland, CO (US)

(72) Inventor: Roger Acers, Loveland, CO (US)

( * ) Notice: Subject to any disclaimer, the term of this patent is extended or adjusted under 35 U.S.C. 154(b) by 0 days.

(21) Appl. No.: 16/111,017

(22) Filed: Aug. 23, 2018

(65) Prior Publication Data

US 2019/0099045 A1 Apr. 4, 2019

Related U.S. Application Data

(63) Continuation of application No. 29/610,386, filed on Jul. 12, 2017.

(60) Provisional application No. 62/549,092, filed on Aug. 23, 2017.

(51) Int. Cl.

| | |
|---|---|
| ***A47K 3/40*** | (2006.01) |
| ***A47K 3/28*** | (2006.01) |
| ***A47K 17/02*** | (2006.01) |
| ***E03F 5/04*** | (2006.01) |
| ***E04B 2/74*** | (2006.01) |
| *E04H 3/08* | (2006.01) |

(52) U.S. Cl.

CPC ..... *A47K 3/40* (2013.01); *A47K 3/284* (2013.01); *A47K 17/022* (2013.01); *E03F 5/0408* (2013.01); *A47K 3/282* (2013.01); *E04B 2/7433* (2013.01); *E04H 3/08* (2013.01)

(58) Field of Classification Search

CPC ..... A47K 3/284; A47K 3/40; A47K 17/022
USPC ..... 4/613, DIG. 15
See application file for complete search history.

(56) References Cited

U.S. PATENT DOCUMENTS

| | | | | |
|---|---|---|---|---|
| 1,622,983 | A * | 3/1927 | Tracy | A47K 3/284 52/265 |
| 4,152,789 | A * | 5/1979 | Heath | A47K 3/284 4/611 |
| D320,843 | S | 10/1991 | Sauter | |
| D322,123 | S | 12/1991 | Smith | |
| 5,671,489 | A | 9/1997 | Salach | |
| D412,028 | S | 7/1999 | Funk | |
| D522,637 | S | 6/2006 | Webster | |
| D618,774 | S | 6/2010 | Bauer | |
| 7,774,902 | B2 * | 8/2010 | Whyzel | A47K 17/022 16/436 |
| D754,288 | S | 4/2016 | Bahler | |
| D822,182 | S | 7/2018 | Acers | |
| 2006/0195980 | A1 * | 9/2006 | Nagley | A47K 3/008 4/595 |
| 2010/0170035 | A1 * | 7/2010 | Kik, Sr. | A47K 3/40 4/613 |
| 2019/0003190 | A1 * | 1/2019 | Mikhaylenko | E04F 21/244 |

* cited by examiner

*Primary Examiner* — Christine J Skubinna
(74) *Attorney, Agent, or Firm* — Santangelo Law Offices, P.C.

(57) ABSTRACT

The inventive technology disclosed herein, in embodiments, relates to a shower stall system that may include an inventive shower drain adaptor ring 11; an inventive anti-ligature grab rail system 30; and inventive, drop-in shower installation related apparatus and methods. Note that all of these may find application in a prison environment, but may find application in other environments as well (e.g., grab rail in kitchen, shower drain adaptor ring in residential shower, etc.).

4 Claims, 37 Drawing Sheets

SHOWER RELATED APPARATUS

REFERENCE TO RELATED APPLICATION(S)

This non-provisional patent application claims priority to U.S. Provisional Application No. 62/549,092, filed Aug. 23, 2017, and is a continuation of and claims priority to U.S. Design application No. 29/610,386 filed Jul. 12, 2017, each said provisional application and said design application incorporated herein in its entirety.

SUMMARY OF INVENTION

The inventive technology disclosed herein, in embodiments, relates to shower systems and related technologies. They include but are not limited to: an inventive shower drain adaptor ring 11 and arrangement; an inventive grab rail system 30; an inventive shower stall 60; and an inventive modesty panel arrangement 90. Note that all of these may find application in a prison environment, but may find application in other environments as well (e.g., grab rail in kitchen, shower drain adaptor ring in residential shower, etc.).

SHOWER DRAIN ADAPTOR RING

As mentioned earlier, the present invention includes a variety of aspects, which may be combined in different ways. The following descriptions are provided to list elements and describe some of the embodiments of the present invention. These elements are listed with initial embodiments; however, it should be understood that they may be combined in any manner and in any number to create additional embodiments. The variously described examples and preferred embodiments should not be construed to limit the present invention to only the explicitly described systems, techniques, and applications. The specific embodiment or embodiments shown are examples only. The specification should be understood and is intended as supporting broad claims as well as each embodiment, and even claims where other embodiments may be excluded. Importantly, disclosure of merely exemplary embodiments are not meant to limit the breadth of other more encompassing claims that may be made where such may be only one of several methods or embodiments which could be employed in a broader claim or the like. Further, this description should be understood to support and encompass descriptions and claims of all the various embodiments, systems, techniques, methods, devices, and applications with any number of the disclosed elements, with each element alone, and also with any and all various permutations and combinations of all elements in this or any subsequent application.

Figure 1:
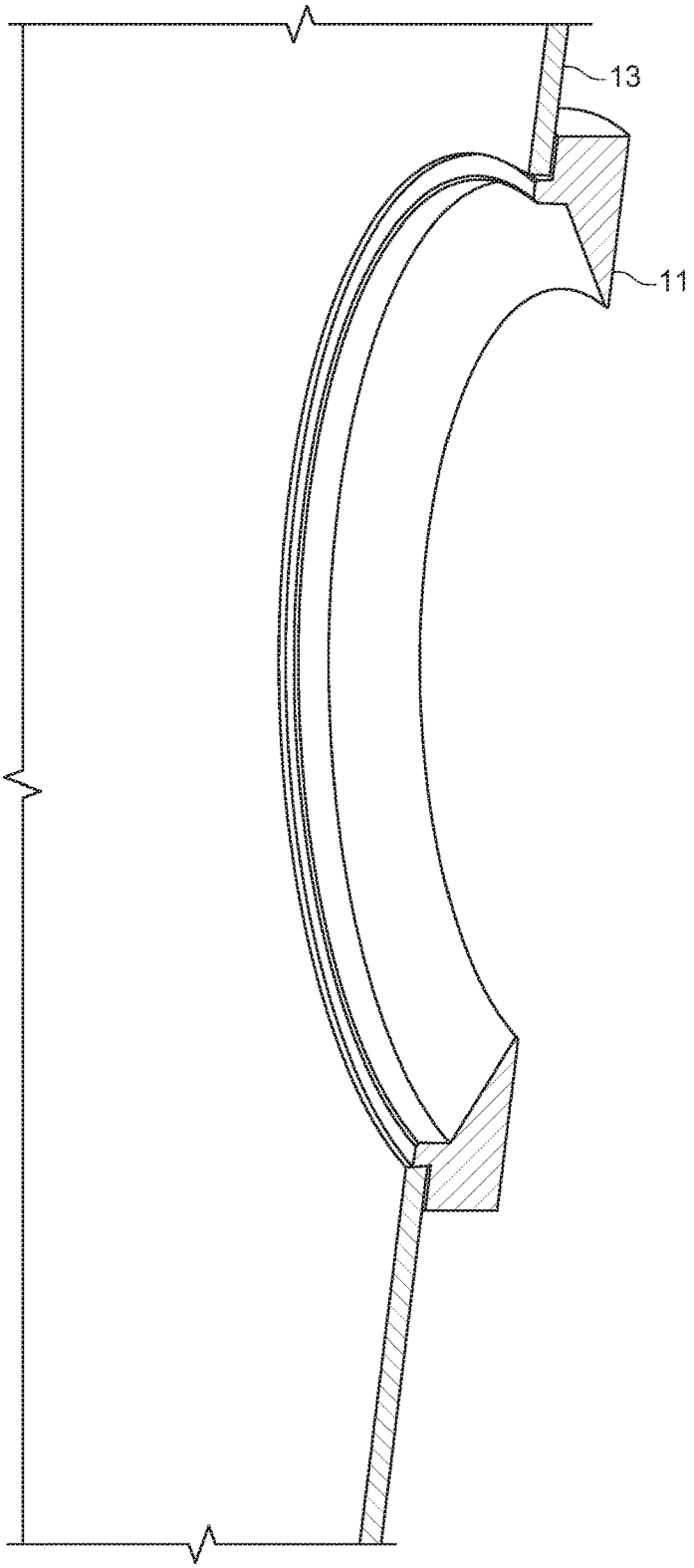
FIG. 1 shows a landscaped view of a drain adaptor ring, in cross-section (and a shower pan), as appears in at least one embodiment of the inventive technology.
Figure 2:
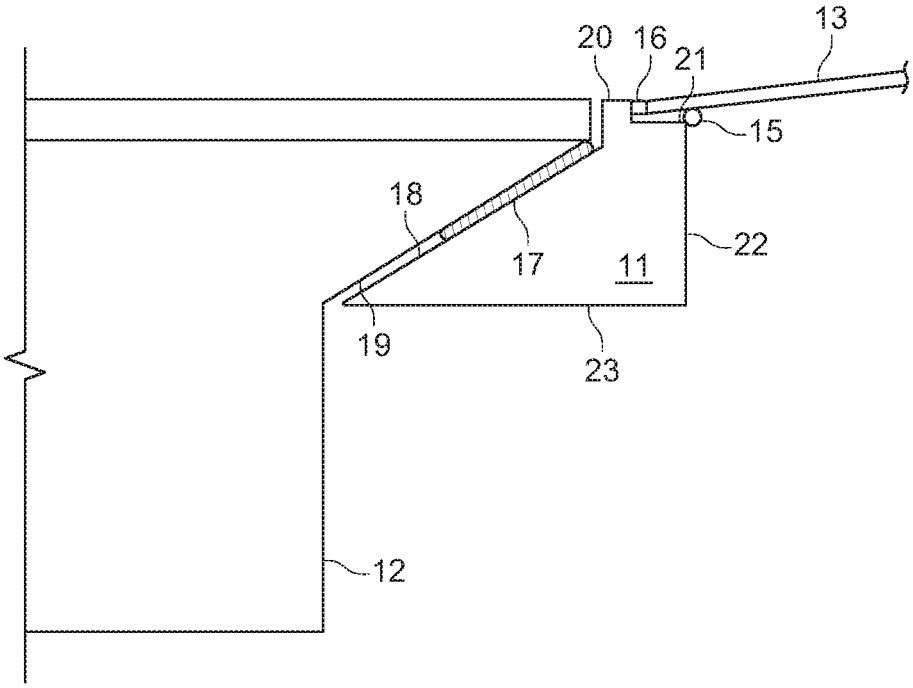
FIG. 2 shows a cross-sectional view of a drain adaptor ring, shower pan, drain, and putty, as appears in at least one embodiment of the inventive technology.

An aspect of the inventive technology relates to an adaptor ring 11 for a shower drain 12. This shower drain may, but need not, be of a shower system particularly designed for use in a prison (including jail, penitentiary, correctional facility, detection center, remand center, or other area of forcible confinement), including as disclosed elsewhere herein. Use of this inventive adaptor ring may preclude the dam effect observed using existing drains, where the drain (or outer perimetrical edges of it) protrude above the shower pan, and water that otherwise would enter and flow down the drain from the pan is instead obstructed and remains on the pan. It may avoid such blockage/damming via a design in cross-sectional profile as shown in FIG. 2. Such profile may, in addition to precluding undesired flow obstruction, allow for welds (structural and/or sealing) between the drain 12 and the adaptor 11 and the pan 13 (which may be metal, such as steel) and the adaptor 11.

In certain embodiments, the structural weld(s) 15 may be made (e.g., during manufacture of the shower stall, or, more generally before final installation) on the underside of the shower pan; sealing weld(s) 16 may be made on the upper side of the pan, between the pan and the adaptor and/or the drain and the adaptor. Seal weld(s), while intended primarily to prevent water from entering between the shower pan and the adaptor, and perhaps the drain and the adaptor, may also provide some degree of structural support. The seal weld(s) may also be made to be flush with the surrounding exposed surfaces (perhaps the drain (on the inside of the adaptor), and/or the shower pan (on the outside of the adaptor)). Putty 7 may also, possibly, be established between the interfacing surfaces (below the upper portion of the adaptor and possibly a seal weld) of the drain and the adaptor.

Figure 3A:
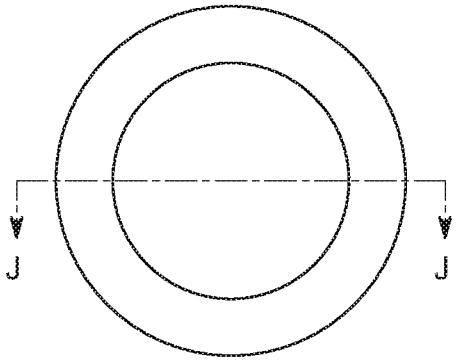
FIG. 3 shows various views of a drain adaptor ring, as appears in at least one embodiment of the inventive technology.
Figure 3B:
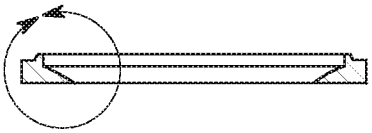
Figure 3C:
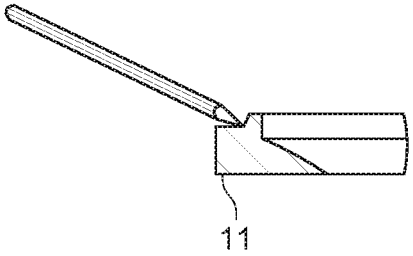
Figure 4B:
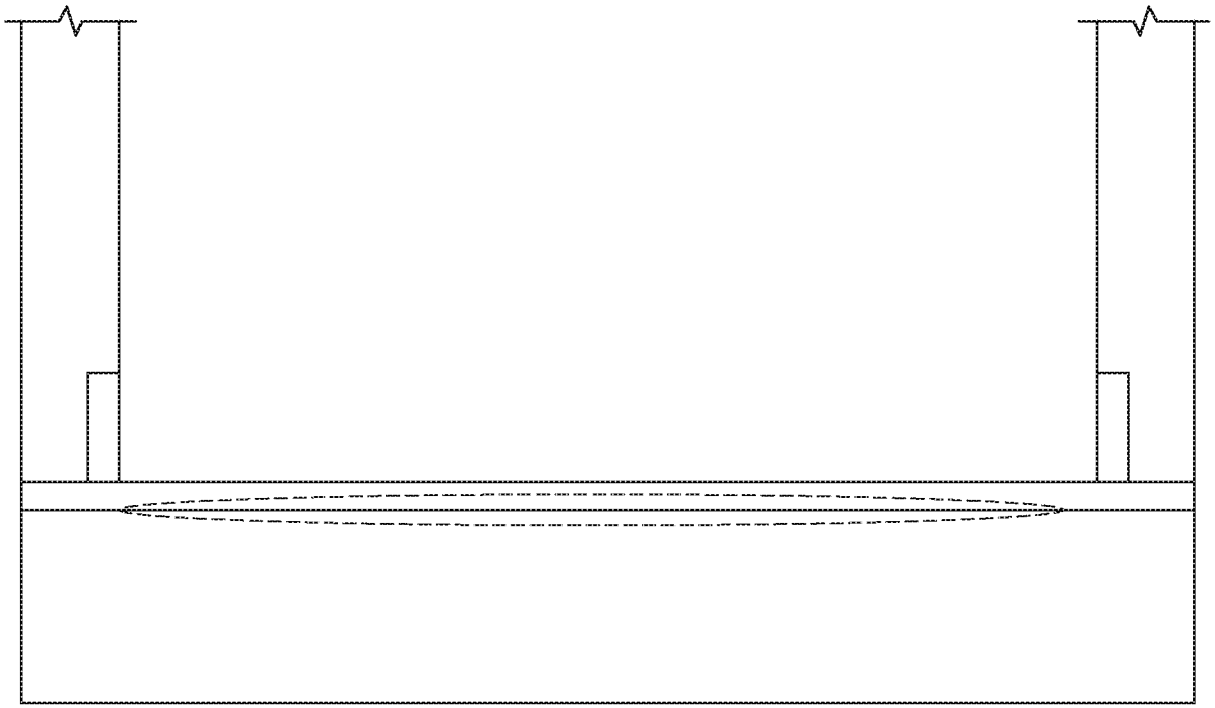
FIG. 4 shows a front view of a shower basin.
Figure 4A:
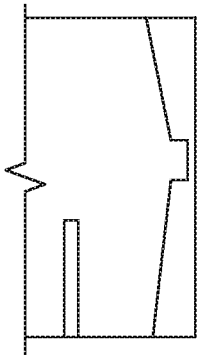
Figure 5:
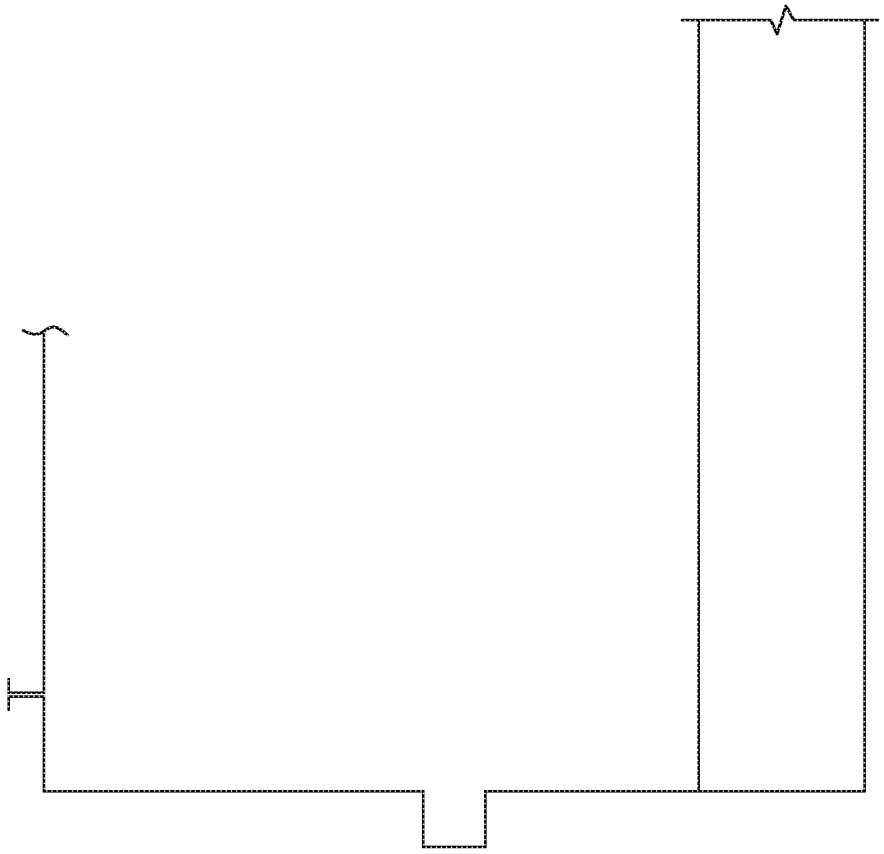
FIG. 5 shows shower basin and shower detail.
Figure 6B:
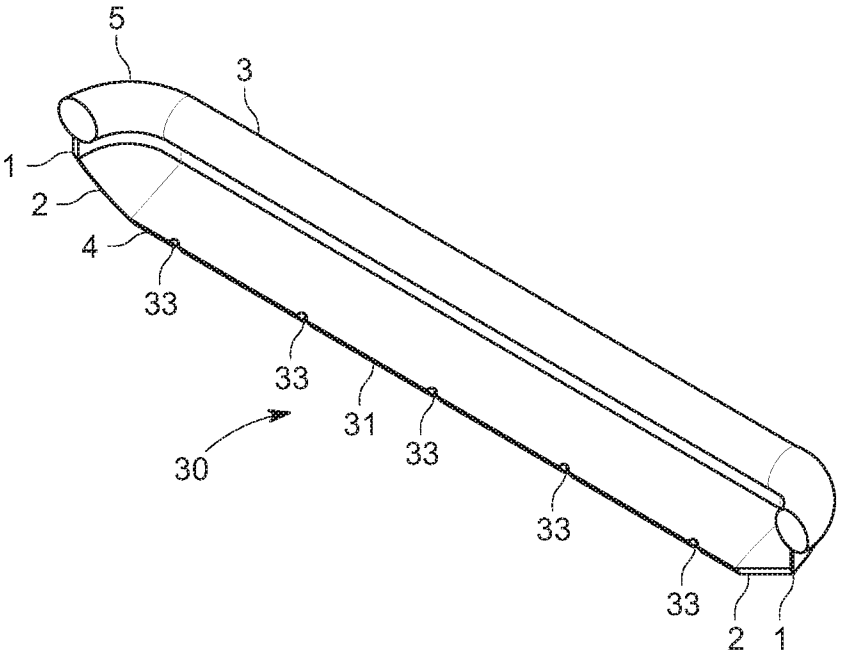
FIG. 6 shows two views of an anti-ligature grab rail, as appears in at least one embodiment of the inventive technology.
Figure 6A:
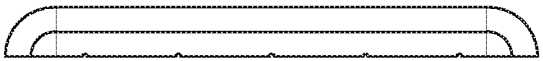

The adaptor ring may feature, starting at the lower left edge of the adaptor (in cross-section): an angled ramp 18 (may provide support to drain; angled to match surface correspondingly angled drain surface 19 (putty 17 may be established between such corresponding, angled adaptor and drain surfaces); vertically protruding annulus 20 (may be three sided: left (vertical), top (horizontal), right (vertical); this annulus may be established substantially between the outer upper edge of the drain and the inner upper edge of the shower pan); a horizontal shelf 21 to the right of the lower portion of the annulus (this shelf may provide support to the inner edge of the shower pan); a vertical wall 22 (on the further right side of the adaptor); and a lower horizontal surface 23 (at the right of the aforementioned lower left edge of the adaptor). Note that in the preceding description right means radially outward and left means radially inward. The adaptor may be a plurality of sizes, and have any of a plurality of relative dimensions, including but not limited to those of FIG. 3. It may be made of metal such as, e.g., steel, as but one example.

Figure 7A:
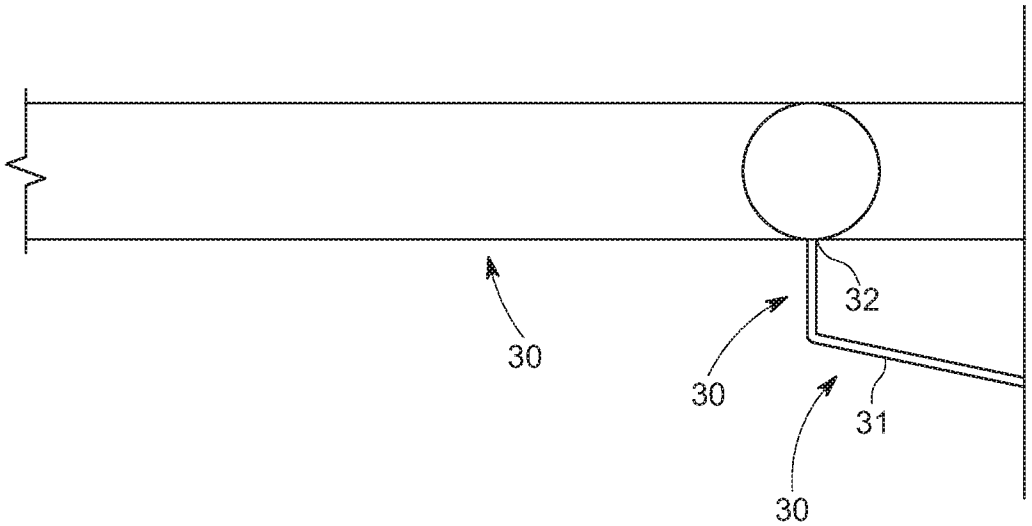
FIG. 7 shows cross-sectional and straight-on views of anti-ligature rails, as appears in at least one embodiment of the inventive technology.
Figure 7B:
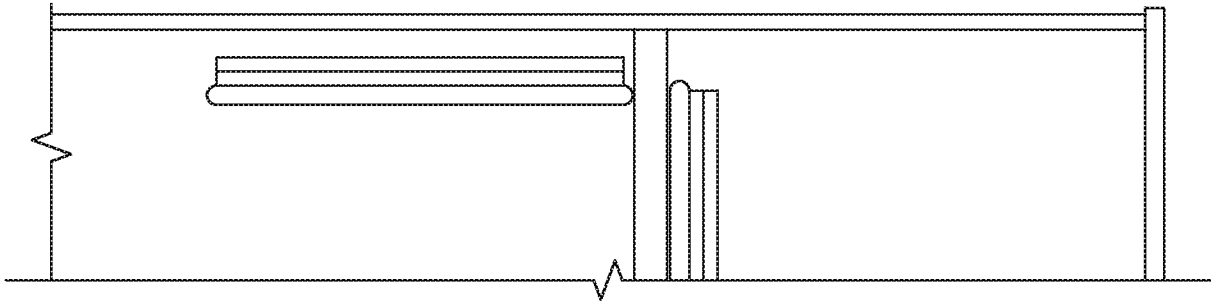
Figure 8:
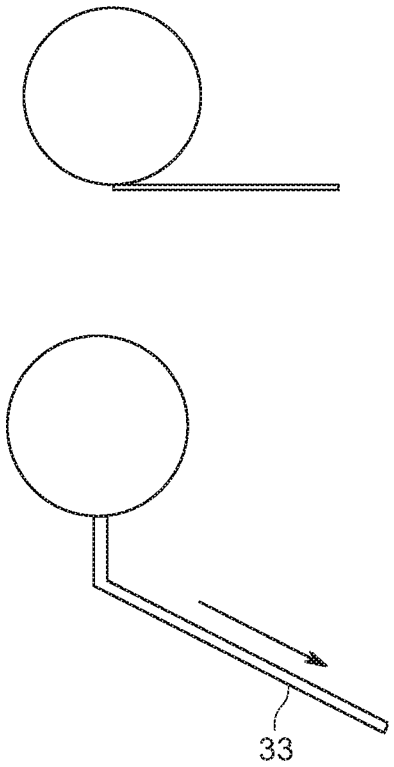
FIG. 8 (PRIOR ART)
FIG. 8 shows cross-sectional views of a prior art and inventive anti-ligature grab rail.
Figure 9:
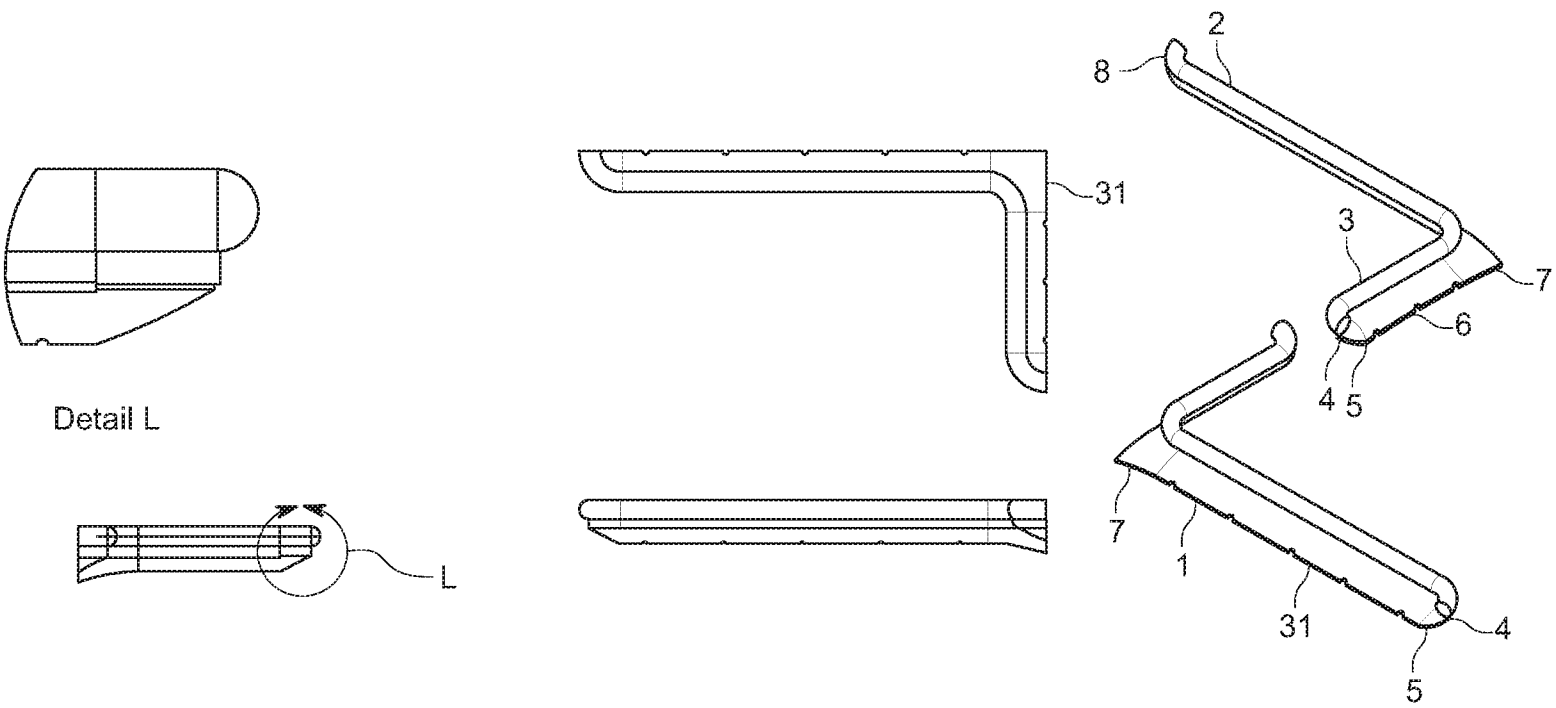
FIG. 9 shows various views of anti-ligature rails, as appears in at least one embodiment of the inventive technology.
Figure 10:
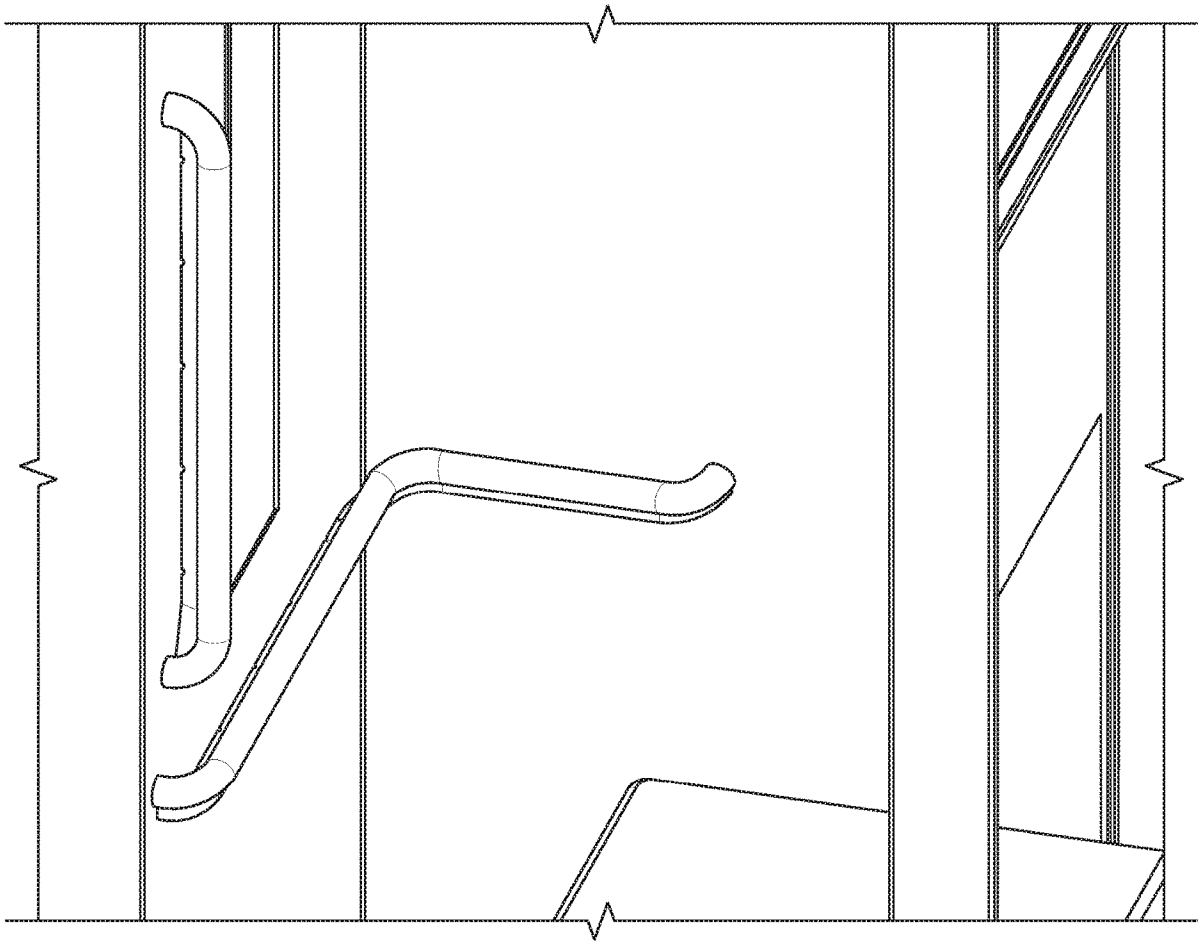
FIG. 10 shows a view of anti-ligature rails, as installed in a shower stall, as appears in at least one embodiment of the inventive technology.
Figure 11:
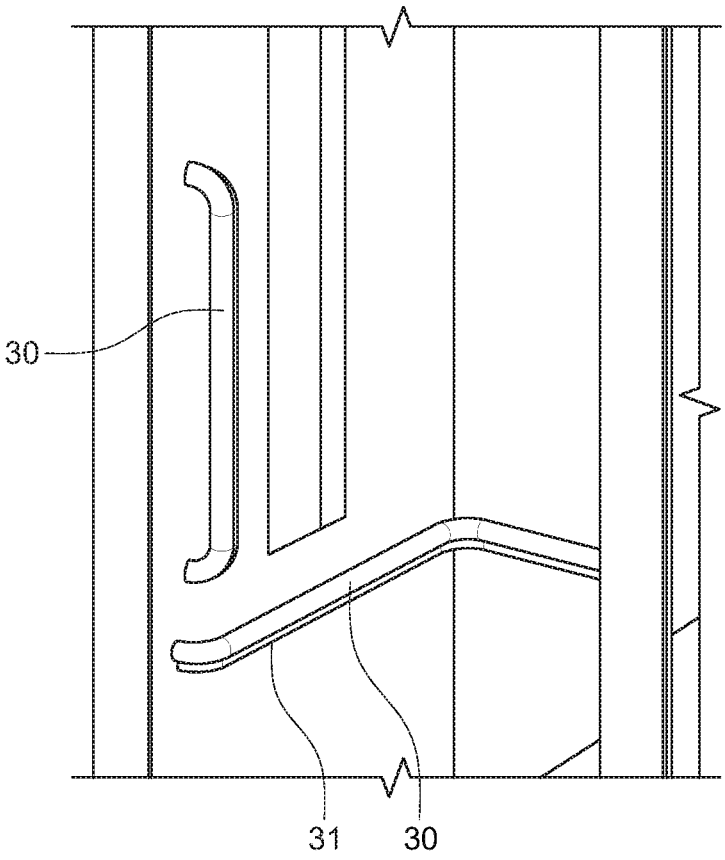
FIG. 11 shows a view of anti-ligature rails, as installed in a shower stall, as appears in at least one embodiment of the inventive technology.
Figure 12A:
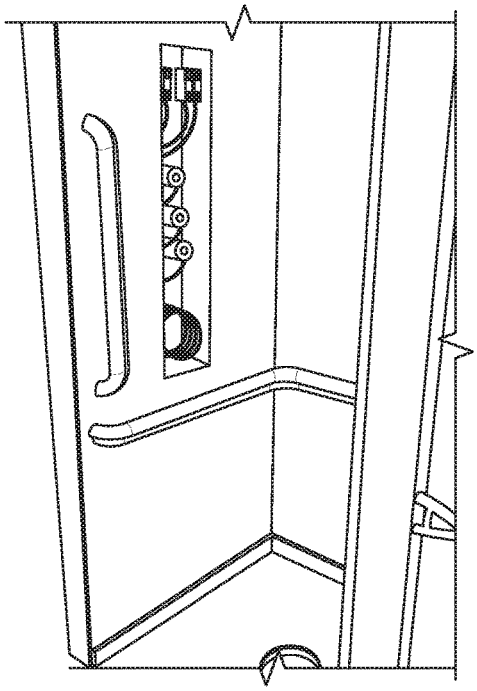
FIG. 12 shows various photographs of anti-ligature rails, as installed and before installation, as appears in at least one embodiment of the inventive technology.
Figure 12B:
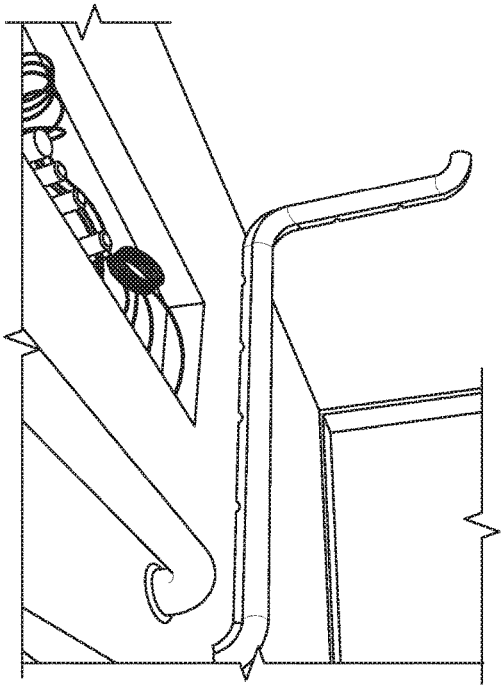
Figure 12C:
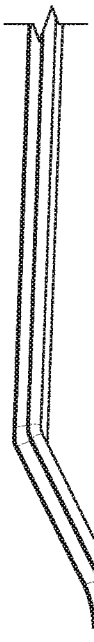
Figure 12D:
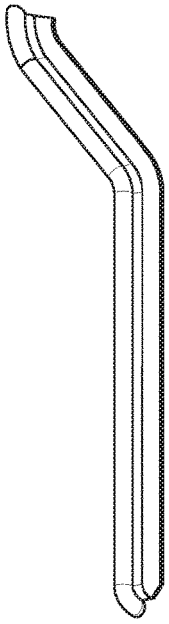

Grab Rail:

Another aspect of the inventive shower system technology may relate to a grab rail system 30. This grab rail system may be used not only in a shower (e.g., including but not limited to a prison shower), but also outside of the shower, but still with respect to a shower system (e.g., on modesty panels), or indeed in any location where a grab rail may be useful (e.g., stairs, toilets, etc.). Inventive grab rail systems may be secured such that the rail is horizontal, vertical, or other. Its inventive features may offer one or more of the following benefits as compared with known grab rail systems: anti-ligature while also offering more hand grip range than known grab rails; anti-ligature while precluding the accumulation of grime near the grab rail in tight, hard-to-reach areas; anti-ligature while preventing the accumulation of water (such prevention possibly achieved via weep holes established where the grab rail support meets the surface (e.g., vertical surface) to which the support is welded; anti-ligature while still working well horizontally, vertically, and angles between horizontal and vertical; and elimination of pinch point(s). Anti-ligature refers to a design that disallows the tethering of ropes, etc., around a structure, that, with regard to the anti-ligature hand rail that may be inside of and part of the shower stall, avoids spatial gaps in the rail support (where such gaps are big enough such that a cable, rope, clothing, etc. can be passed), and at the ends of the rail (such that the rail does not protrude at its ends in a manner that would allow a rope or cable, e.g., to be tied off around the rail end). Such design helps to prevent intentional ligature-caused injury or death. One or more of such benefits may be achieved via the design shown in cross-section in FIGS. 7 and 8.

The grab rail support 31 (e.g., sheet-type support), instead of attachment (e.g., via weld) to the grab rail via a tangential interface, may instead attach to the grab rail via a radial interface 32 with the grab rail (i.e., substantially as a radial projection from the grab rail (in cross-section)). Such attachment may also allow for a larger grip range, potentially rendering as ADA compliant known rails that are not. It may also achieve a seamless connection (making the grab rail and support (the grab rail system) look like a single unit) and make the grab rail and the system in the area of the grab rail easier to clean (due to elimination of the hard-to-reach area where the grab rail meets the grab rail support) in known systems where the support interfaces the grab rail as a tangent thereto. Such attachment may be via a weld substantially along at least portion(s) of the length of the grab rail. A weld may also be used to attach the grab rail support to the surface (e.g., vertical shower stall surface), perhaps creating a seamless connection. Note that in particular embodiments, the design will assure that the weld will not interfere with the draining operation of weep holes 33 (whether by establishing weep holes through the weld after the weld is made, by situating weep holes off the site of the weld, or merely staggering welds and weep holes (such that wherever there is a weep hole, no weld is made). Note that weep holes may be used only in horizontal grab rails (e.g., in "valleys," where water may accumulate), or at the lowest parts of non-horizontal grab rails (e.g., pits, where water may accumulate); they allow water to drain from catchment(s) formed by the rail supports 31.

Shower Stall:

Another aspect of the inventive shower system technology may be a shower stall 60. Such stall may be a factory manufactured stall (where much of the manufacturing takes place off site of the eventual installation). It may be manufactured so as to be dropped into place during installation, or so that it can be shipped flat, have its sides and bottom perhaps securely attached to one another (e.g., via bolting), and then dropped into place. Upon installation, foam filled sides and secure drop in type connection to surrounding walls may give it a durable, solid feeling.

Figure 15:
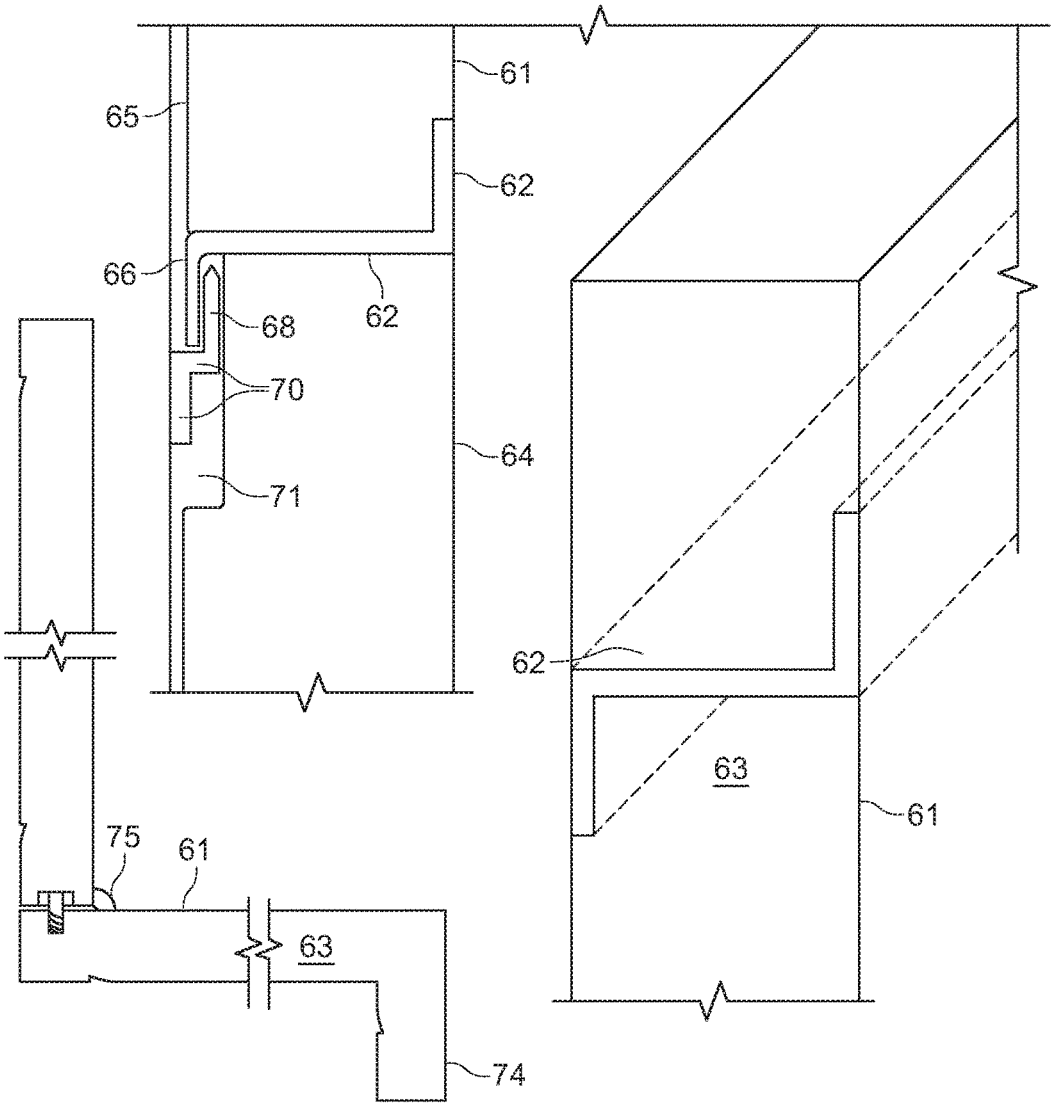
FIG. 15 shows cross-sectional views of shower stall walls, and components that secure such walls to facility walls, as appears in at least one embodiment of the inventive technology.
Figure 16:
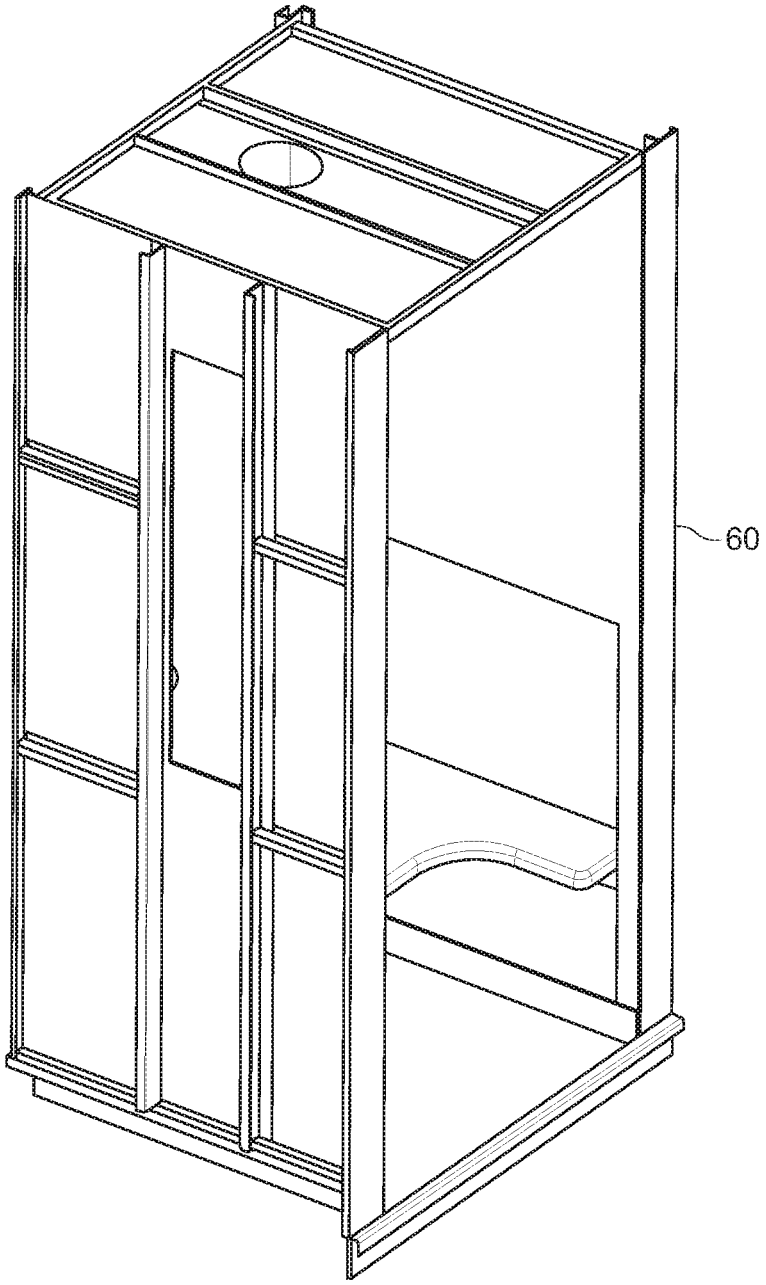
FIG. 16 shows a perspective view of a shower stall, with wall behind folding seat removed, and folding seat in down position, as appears in at least one embodiment of the inventive technology.

Stall Walls 61: The three walls of the stall may be given a solid feel via establishment, between the inner and outer panels of each of the right, rear, and left walls, the following: purlins 62 that add structural support to the walls (indeed, they may act as wall stiffeners, and also may be part of a stall to surrounding wall attachment system); and foam 63 established between the inner 64 and outer stall panels 65 (e.g. of each wall) and filling at least a majority portion of the volume between such panels. More generally, e.g., as where the stall does not have outer panels, the stall system may be said to have an outer surface, and the purlins may be established outside of the inner stall panel(s) (the outer stall surface may be a foam surface or, where the stall system does have outer panels, an outer panel surface). The purlins may travel from one side of each wall to another, and be established between the inner and outer panels of such wall; there may be a purlin at each of one, two, three, or more different heights for each wall. They may be made of sufficiently strong material (e.g., metal) and may have a cross-sectional shape as shown in FIG. 15. Walls can be bolted and/or welded together.

Securement of Stall Wall to Facility Wall: The purlin's shape may enable an outer vertical portion 66 of the purlin to engage a prong 68 of purlin connector 70 that is secured at a operatively corresponding height on a facility (e.g., prison) wall (e.g., concrete) to which the shower stall is secured during installation (operative correspondence denotes heights that, when the shower system is installed, are substantial (e.g., within 10% of each other) the same. Such engagement may require that the outer vertical portion (outer leg) of the purlin be exposed, and such may require that at least portions of the outer stall panel, where it exists, and perhaps some foam below the outer purlin leg, be removed to allow the prong 68 of the purlin connector 70 to be established below (and interiorly of) the outer purlin leg so thereafter the stall wall (perhaps as part of an assembled stall) can be lowered into sliding purlin engagement. Note that the height of such debridement may be at least the height of the prong. It may also be that additional material be removed interiorly of the outer purlin leg so the prong of the purlin connector can be slid into engaged position. Note that instead of material removal (e.g., debridement), the wall and foam may be manufactured (e.g., via molding) such that at least part of the wall and/or foam has a cross-sectional "exposed" shape (with cavity 71) that will allow for engagement without debridement of wall and/or foam. Again, such exposure may be required to enable the purlin connector attached to the facility wall (via, e.g., bolts) to which the stall wall is to be secured to engage the outer purlin leg of a shower stall wall. Such engagement may be facilitated via additional measures, e.g., shaping the purlin and/or the portion of the purlin connector, so that such engagement (when dropping the shower stall into place from above) is more assured, secure and/or easier. Such shaping may take place, e.g., during manufacture of the purlin or purlin connector. In a more general sense, it is of significant note that certain embodiments of the inventive technology, in allowing for drop in, lowering type installation of a shower stall, may provide significant benefits with respect to shower stall installation efficiency as compared with prior art apparatus and methods.

Engagement after installation will typically exhibit an outer purlin leg that is between the outer panel of the stall wall and the purlin connector (or more particularly, its prong), and in contact with that purlin prong, as shown in FIG. 15. Note that such engagement need not take place along the entire side to side length of the stall wall, as it may be sufficient (and even desired for reasons relative to, perhaps, lessened costs and greater stall wall strength), for such engagement to take place only at one, two or a few locations for each purlin. Accordingly, there may be horizontal gaps between the purlin connectors, on the facility wall (e.g., concrete wall) to which the purlins are attached, and horizontal gaps (of no exposed purlin portion 66) between corresponding portions on the outer surface (e.g., wall or foam) of the shower stall where an outer purlin leg is exposed. Note that it is not the case that every single purlin for a single stall wall be engaged to a purlin connector (although that may certainly be advisable to more securely attach the stall wall to the facility wall). Of course, purlins may, but need not necessarily, be secured somehow to the inner surfaces of the panels of the stall wall in which they are established.

Not that in, e.g., the left stall wall, one or more of the purlins of that wall may not travel from the far left side of that wall to the far right side (right and left are from the perspective of someone inside the shower facing that wall), as there may be a control panel port that interrupts a portion of the wall (so any purlin(s) in that height range may travel from the far left side of the wall to the left edge of the port, and from the right side of the port to the far right side of that wall). The purlin engagement components (e.g., the purlin connector and the purlin) may be established at a height that allows for the purlin engagement components to support none, all, or only a portion of the weight of the shower stall, as desired. The foam may be any of the well-known types of foam used to, e.g., fill voids (e.g., metal foam, polyurethane foam, etc.).

Figure 17:
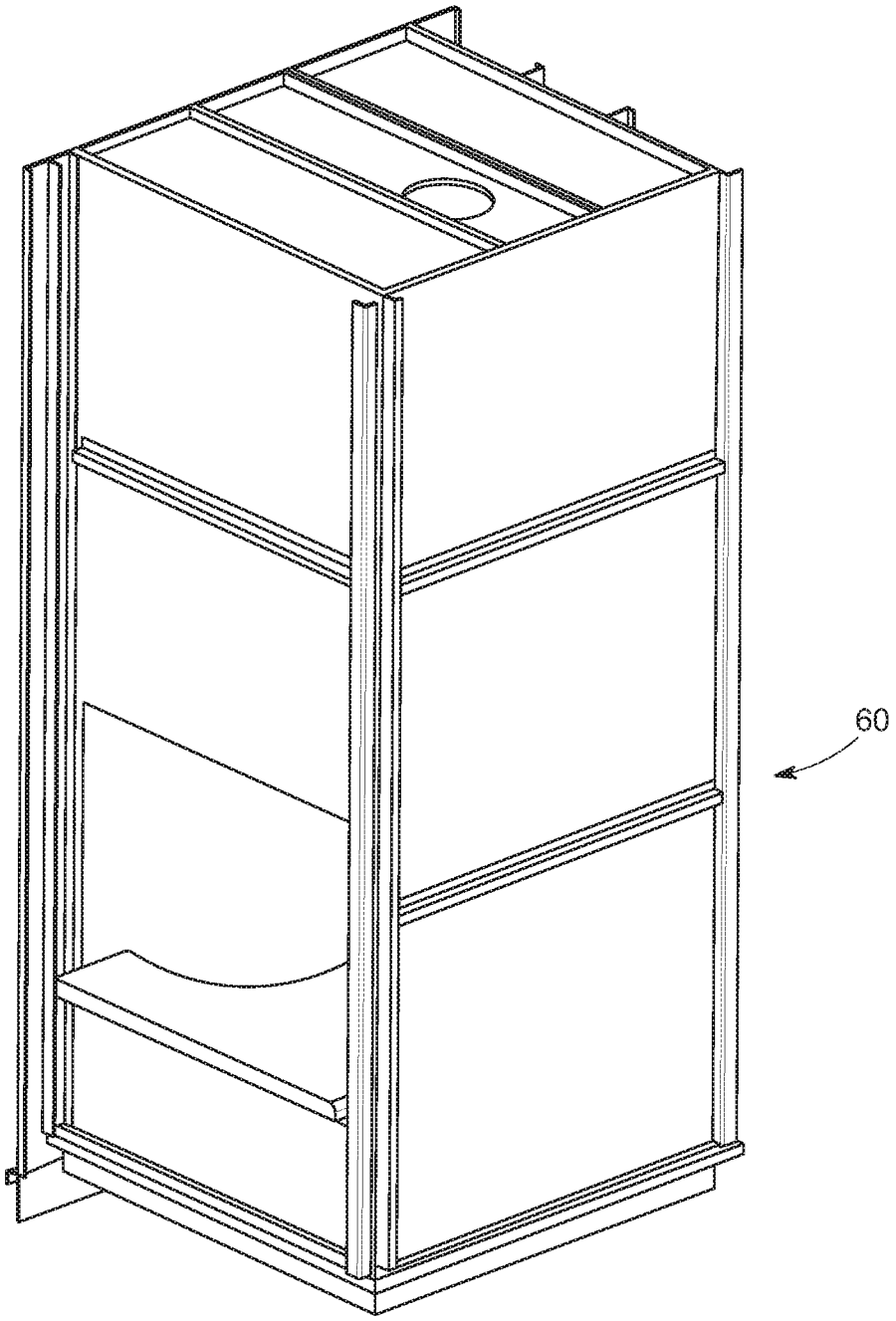
FIG. 17 shows a perspective view of a shower stall, with wall behind folding seat removed, and folding seat in down position, as appears in at least one embodiment of the inventive technology.
Figure 18:
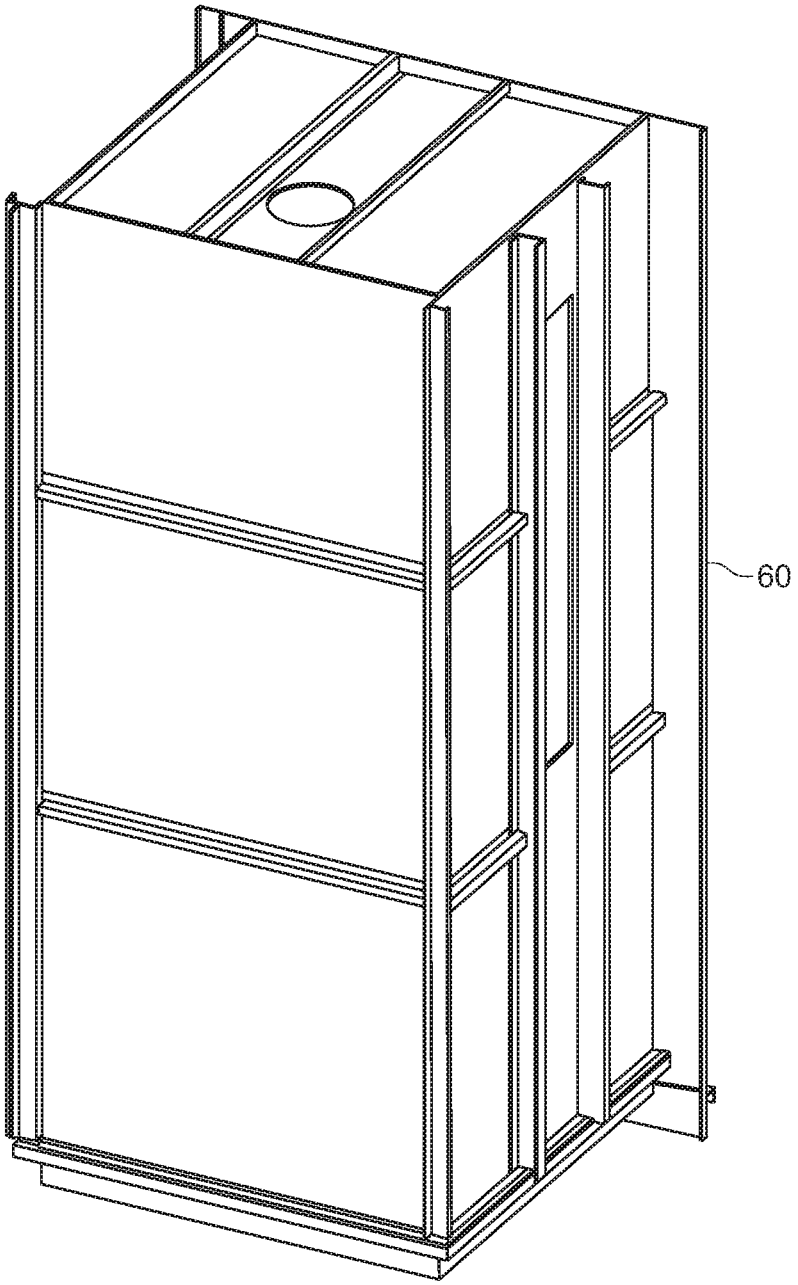
FIG. 18 shows a perspective view of a shower stall, with control port, as appears in at least one embodiment of the inventive technology.
Figure 19A:
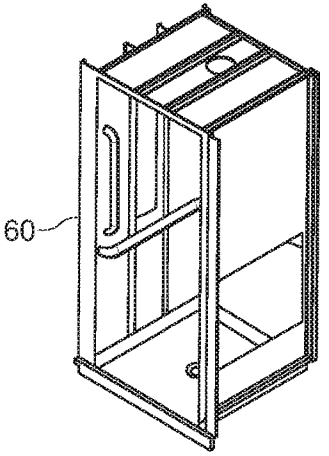
FIG. 19 shows various views of a shower stall, including grab rails, as appears in at least one embodiment of the inventive technology.
Figure 19B:
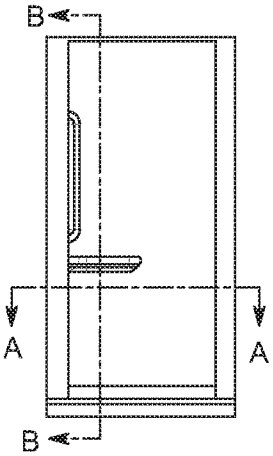
Figure 19C:
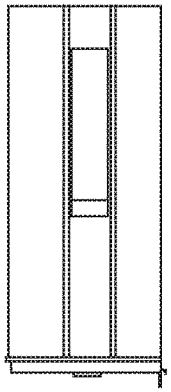
Figure 19D:
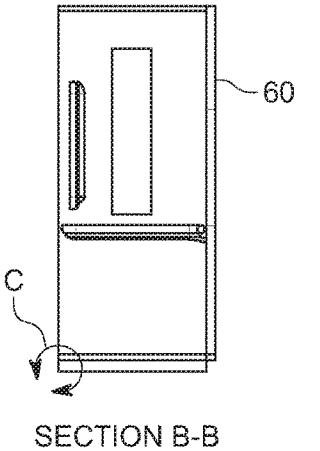
Figure 19E:
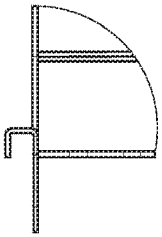
Figure 19F:
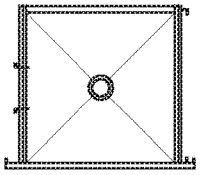
Figure 19G:
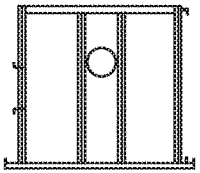
Figure 20:
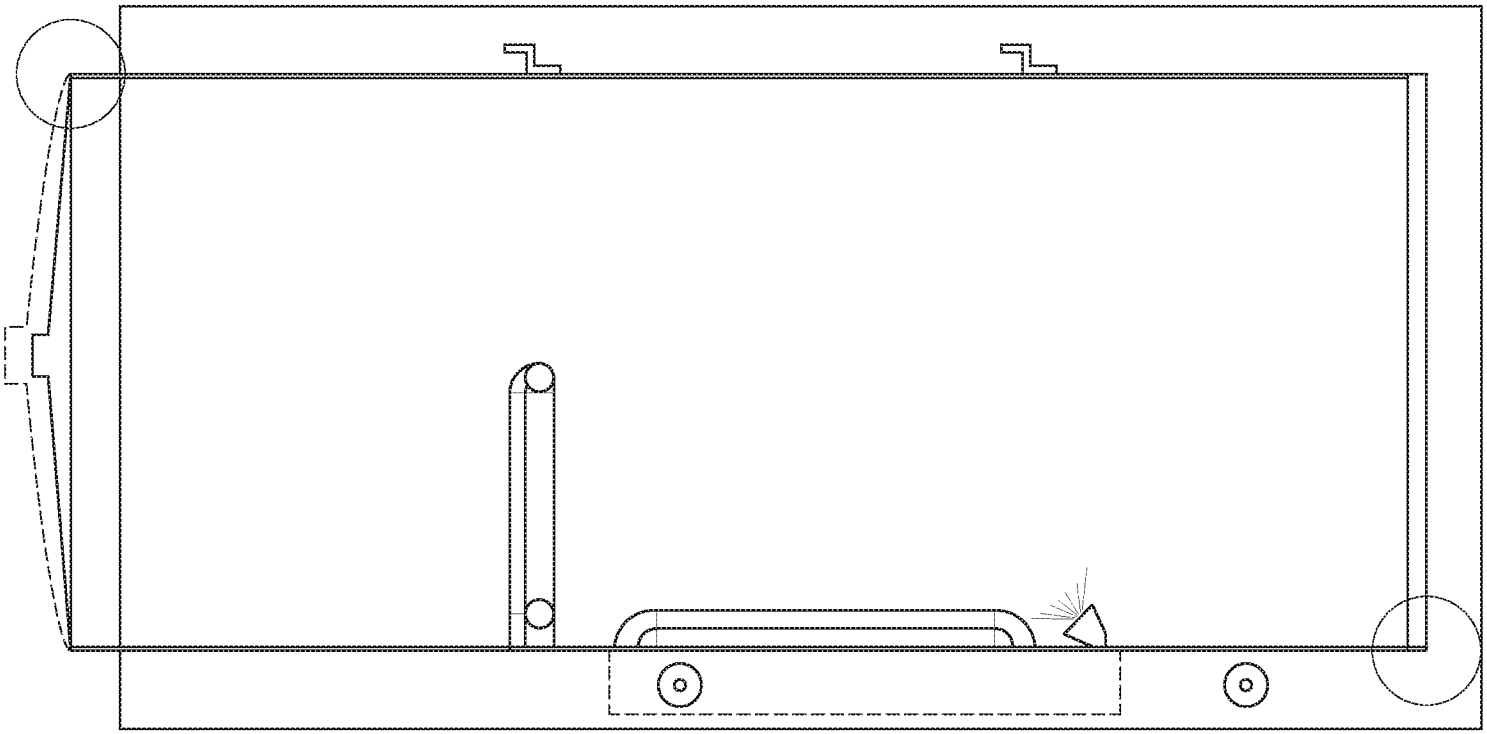
FIG. 20 shows a view of a shower stall, and associated detail (e.g., grab rails), as appears in at least one embodiment of the inventive technology.
Figure 21:
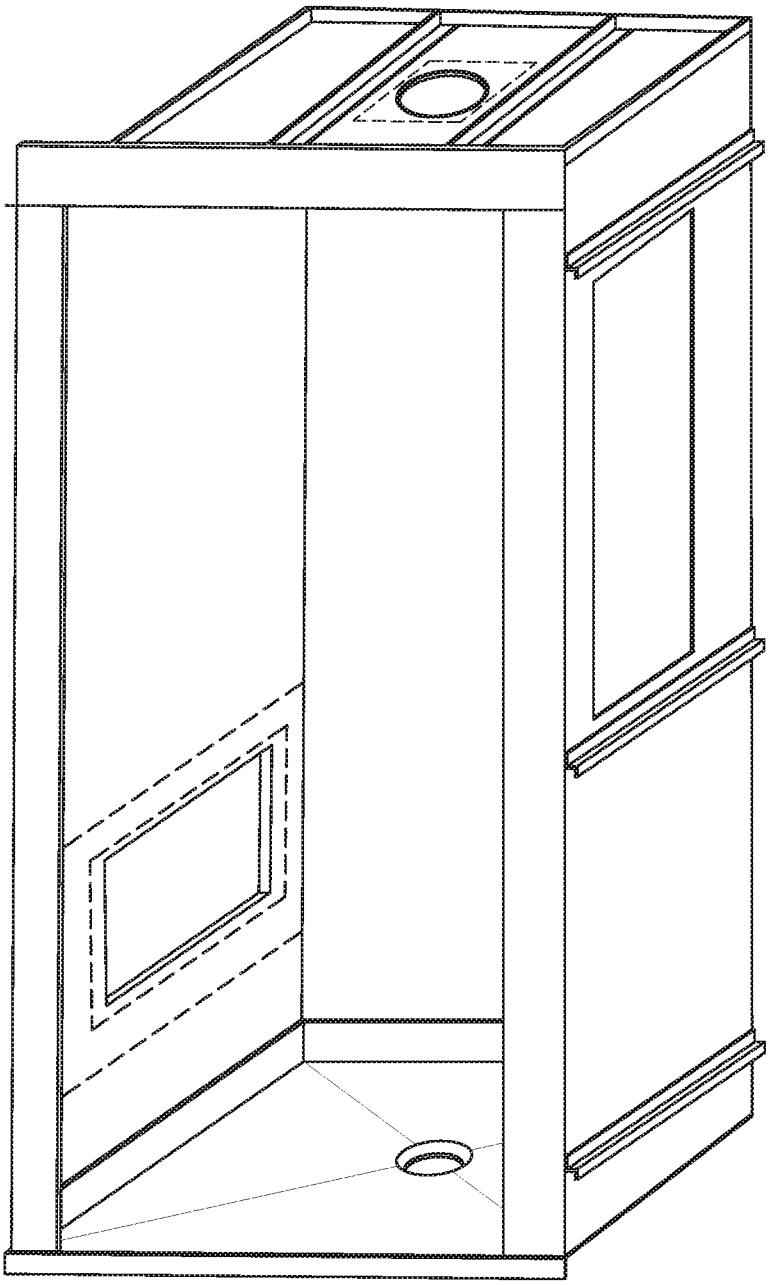
FIG. 21 shows a view of a shower stall, and associated detail, as appears in at least one embodiment of the inventive technology.
Figure 22:
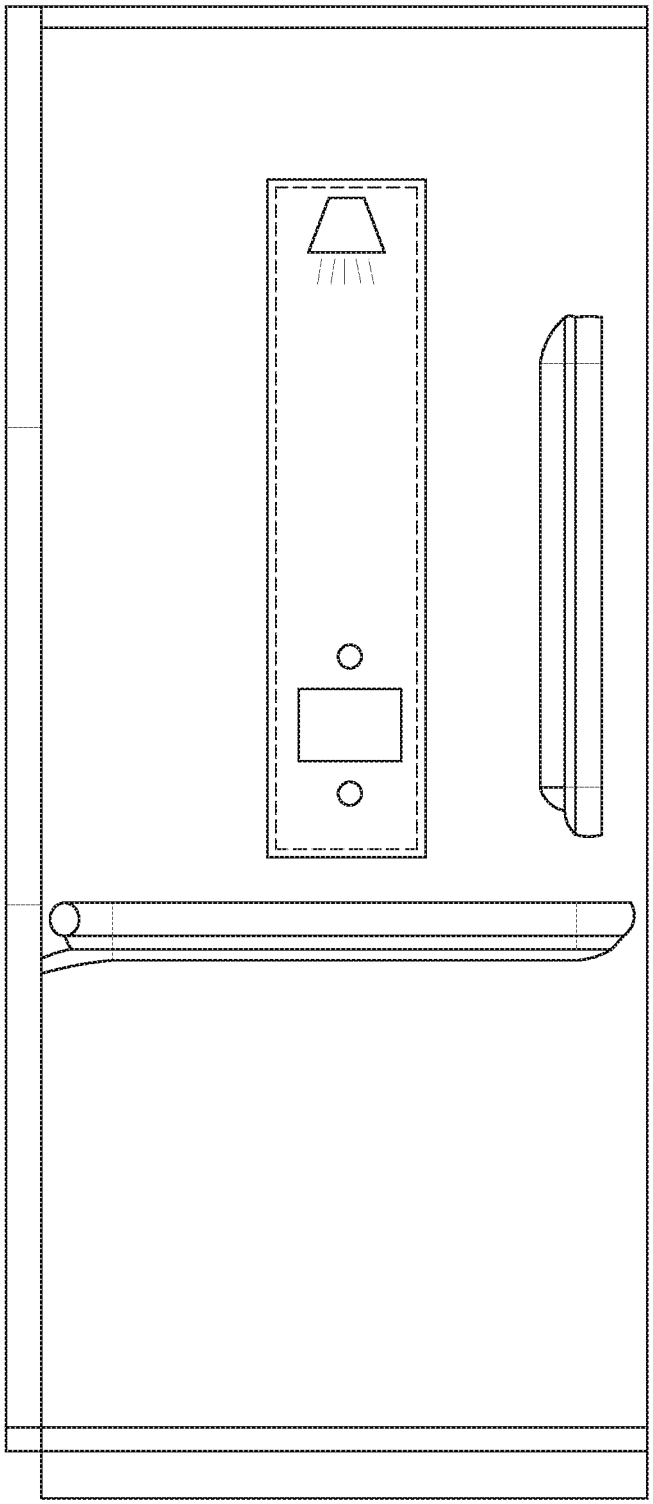
FIG. 22 shows a view of a shower stall, and associated detail, as appears in at least one embodiment of the inventive technology.
Figure 23:
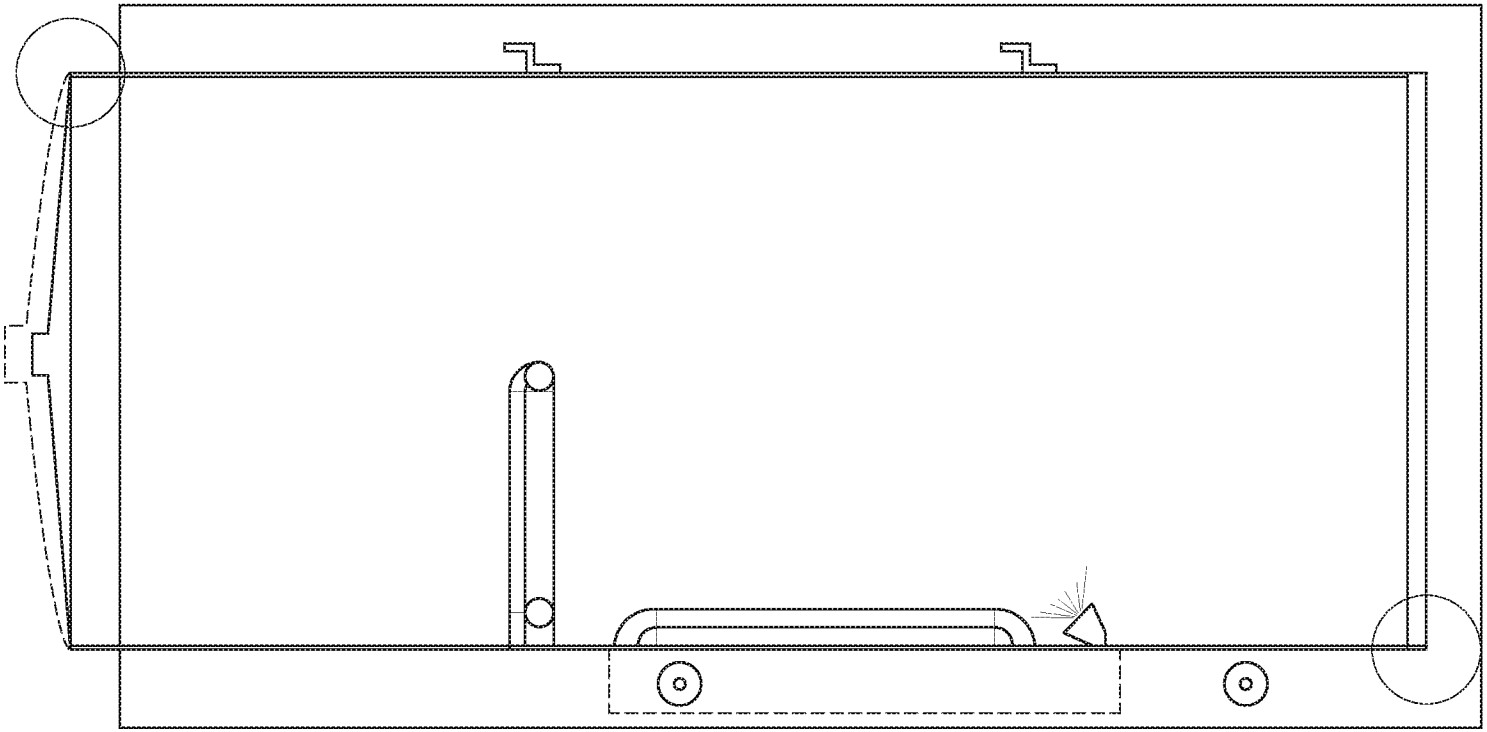
FIG. 23 shows a view of a shower stall, and associated detail, as appears in at least one embodiment of the inventive technology.
Figure 24A:
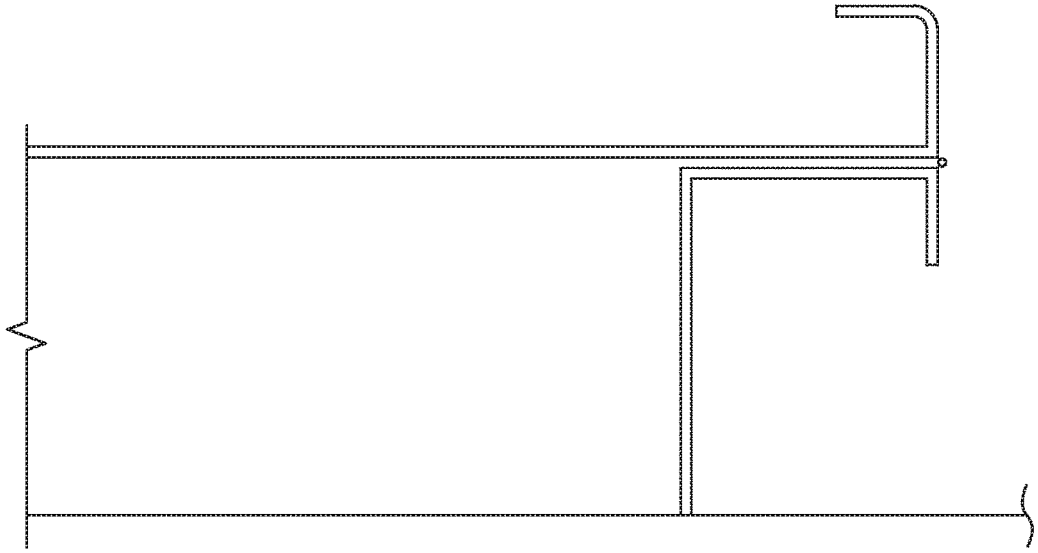
FIG. 24 shows a view from above of a shower stall, and associated detail, as appears in at least one embodiment of the inventive technology.
Figure 24B:
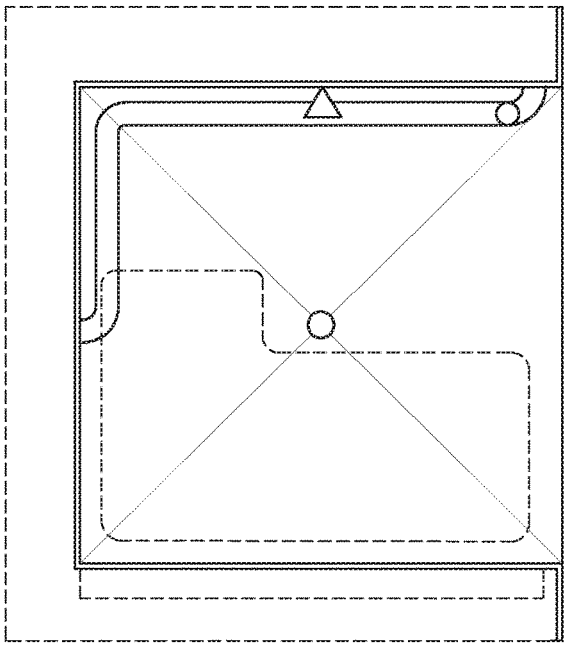
Figure 25:
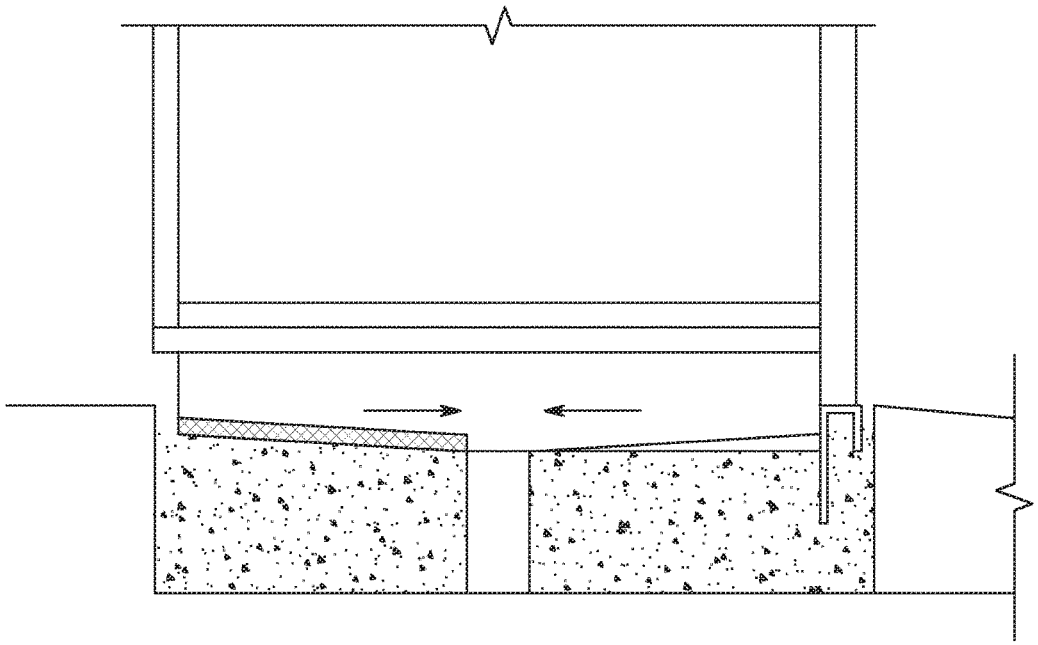
FIG. 25 shows a side view of a shower stall basin.
Figure 26:
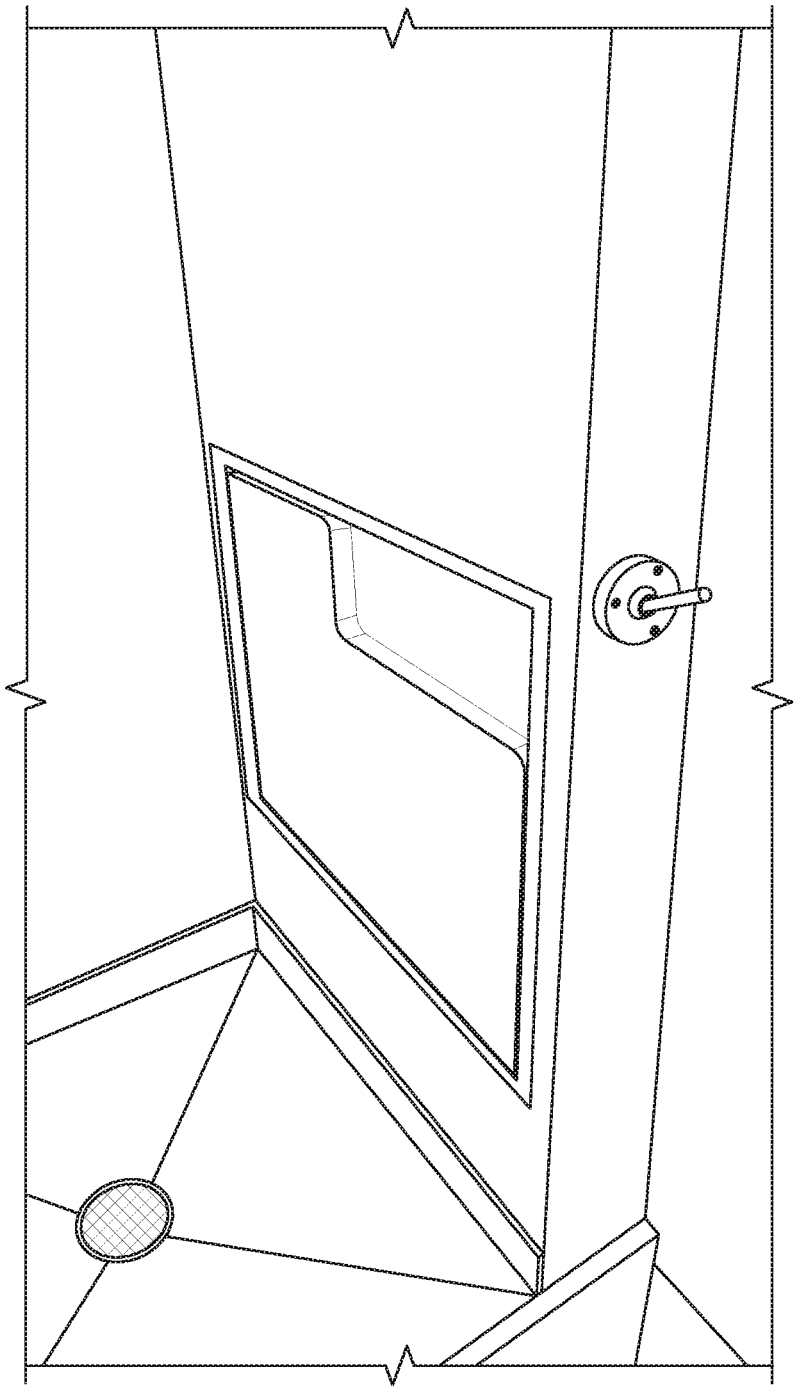
FIG. 26 shows a photograph of the interior of a shower stall, with seat in folded up position, as appears in at least one embodiment of the inventive technology.
Figure 27:
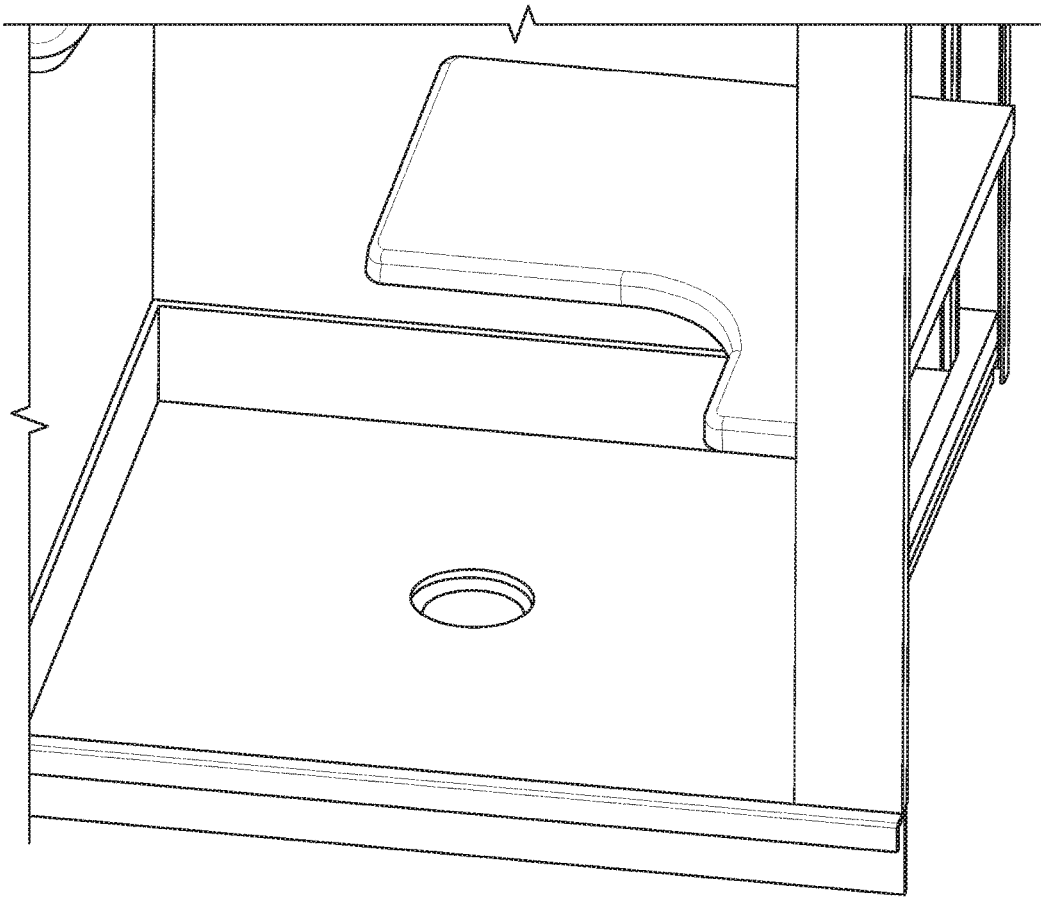
FIG. 27 shows a perspective of a portion of the interior of a shower stall, with seat in folded down position, and right wall removed, as appears in at least one embodiment of the inventive technology.
Figure 28:
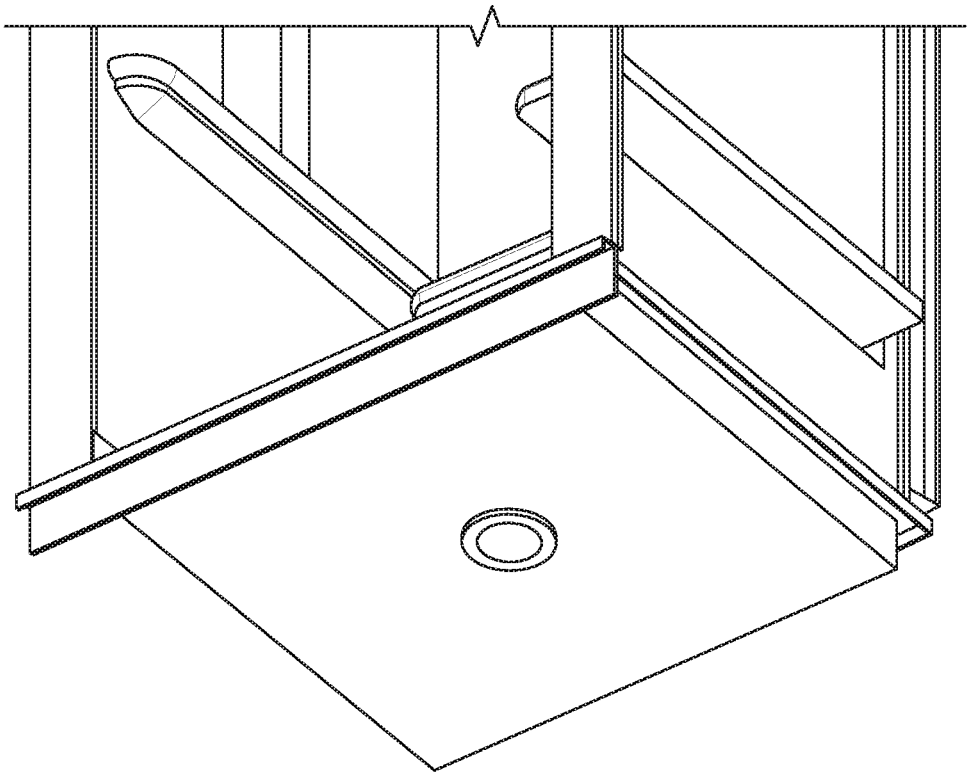
FIG. 28 shows a view from below, of a shower stall, as appears in at least one embodiment of the inventive technology.
Figure 29:
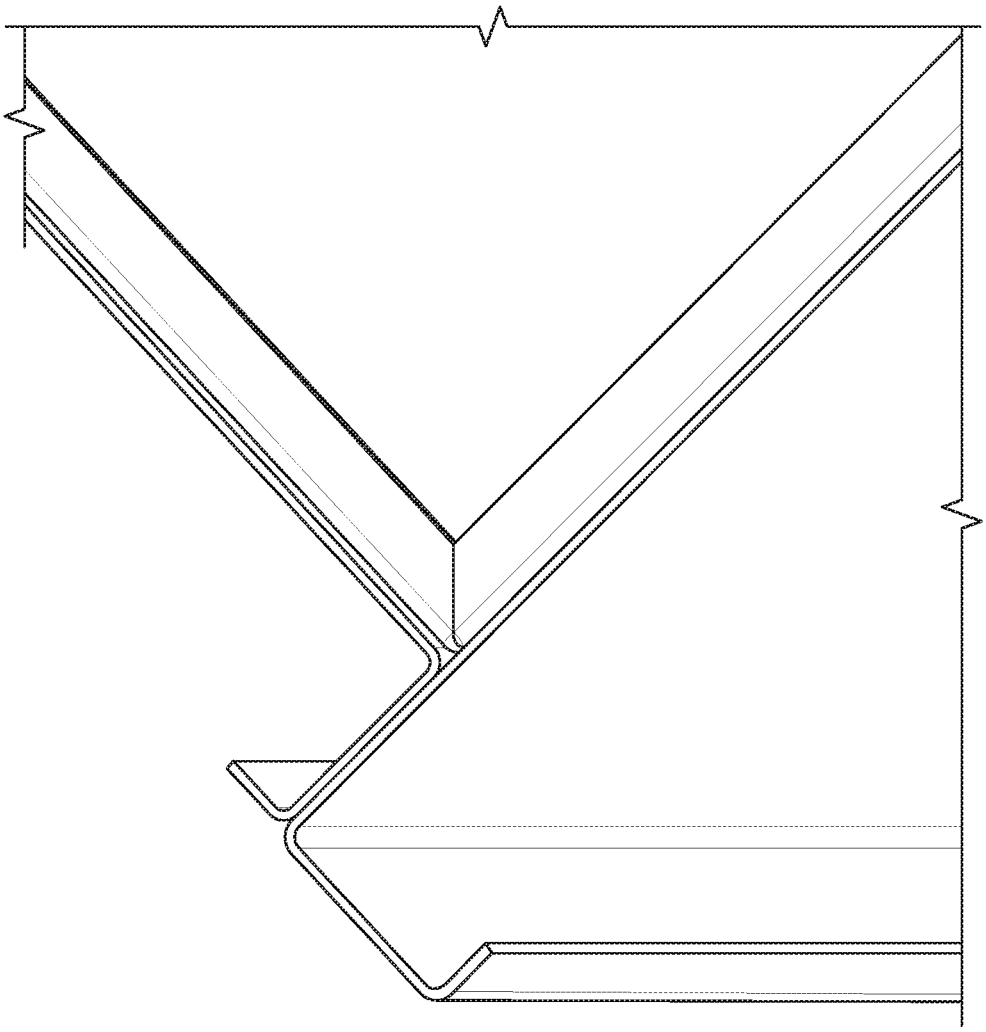
FIG. 29 shows a perspective view of a corner of a shower stall, as appears in at least one embodiment of the inventive technology.
Figure 30:
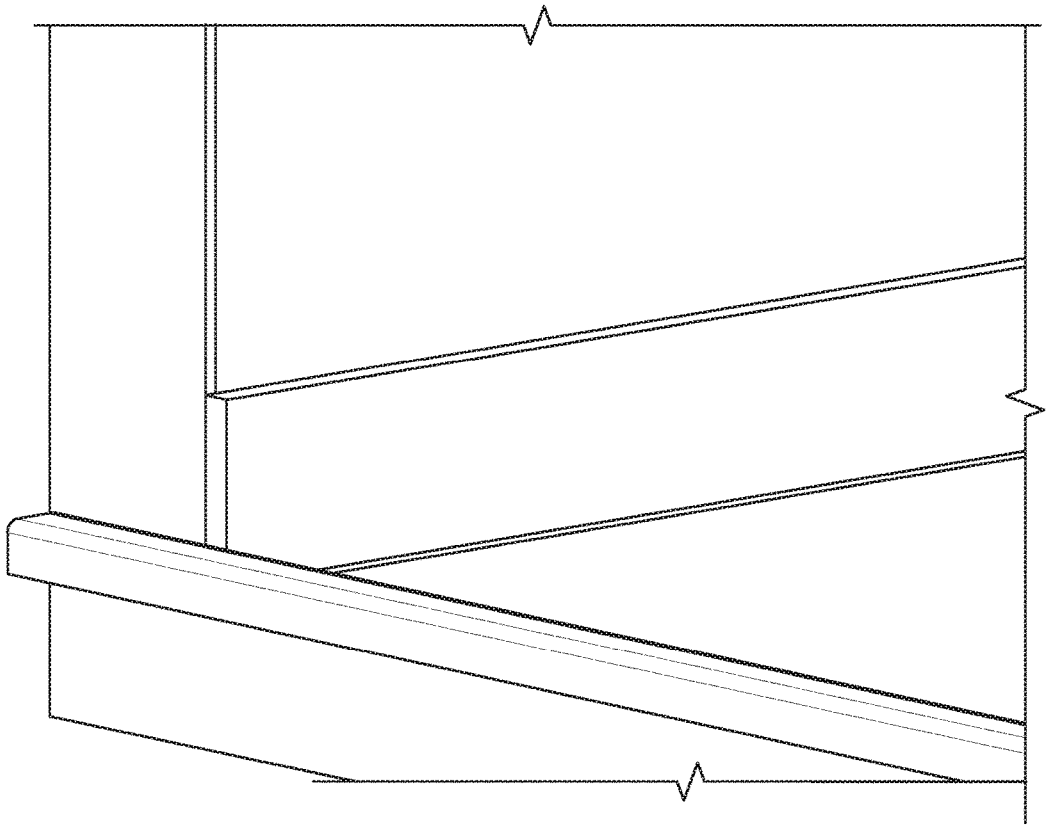
FIG. 30 shows a perspective view of corner of the opening of a shower stall, as appears in at least one embodiment of the inventive technology.
Figure 31:
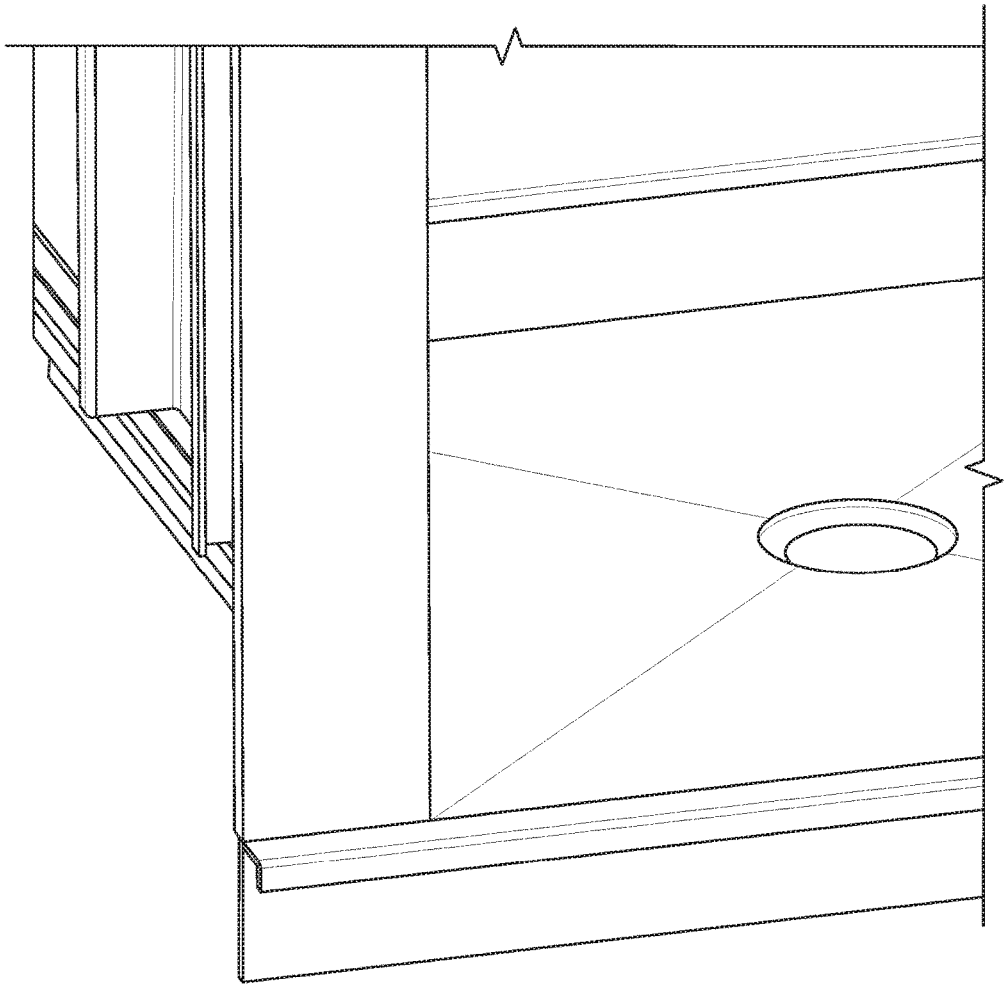
FIG. 31 shows a perspective view of the basin of a shower stall, as appears in at least one embodiment of the inventive technology.
Figure 32:
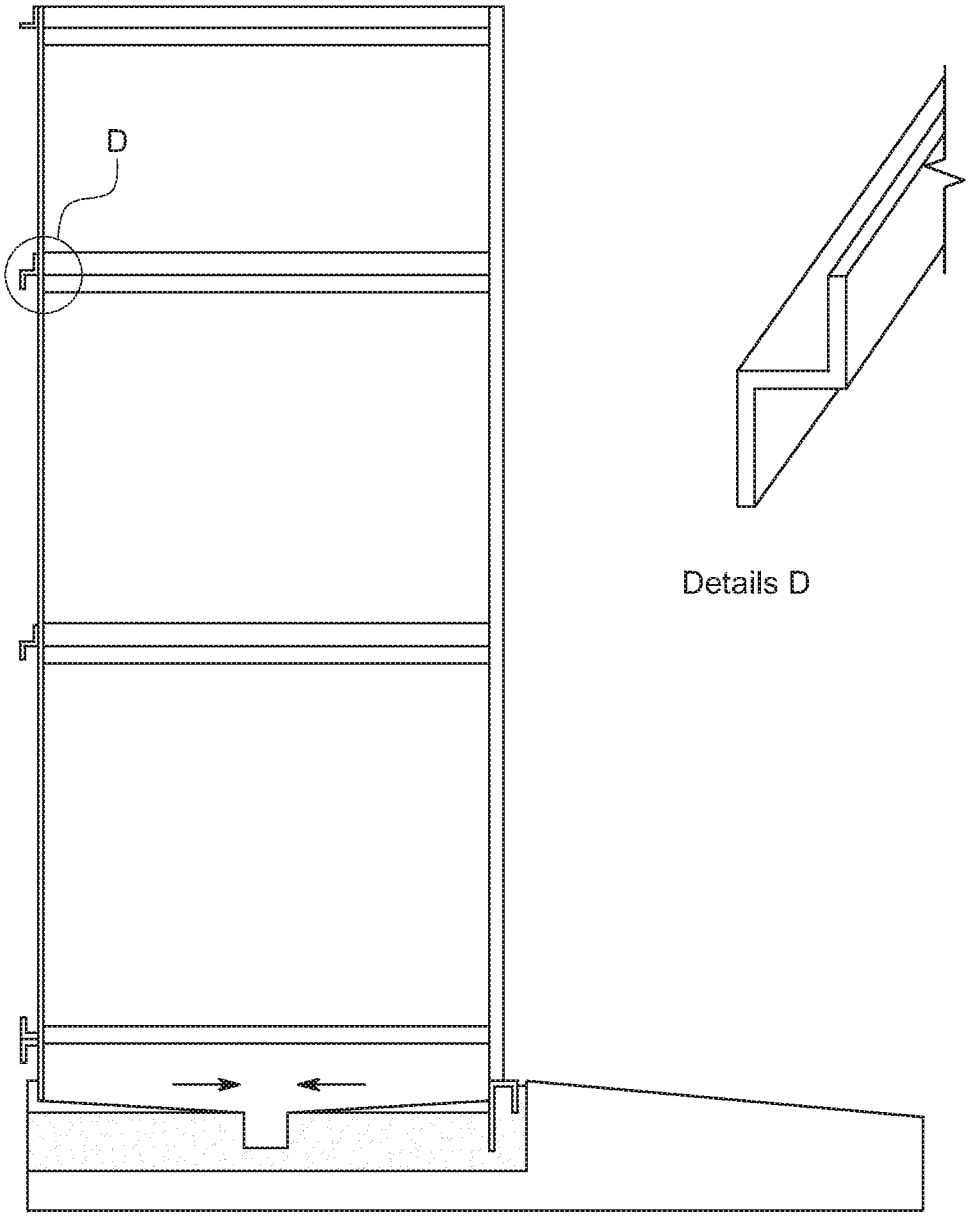
FIG. 32 shows a side view of a shower stall, including purlins, as appears in at least one embodiment of the inventive technology.
Figure 33:
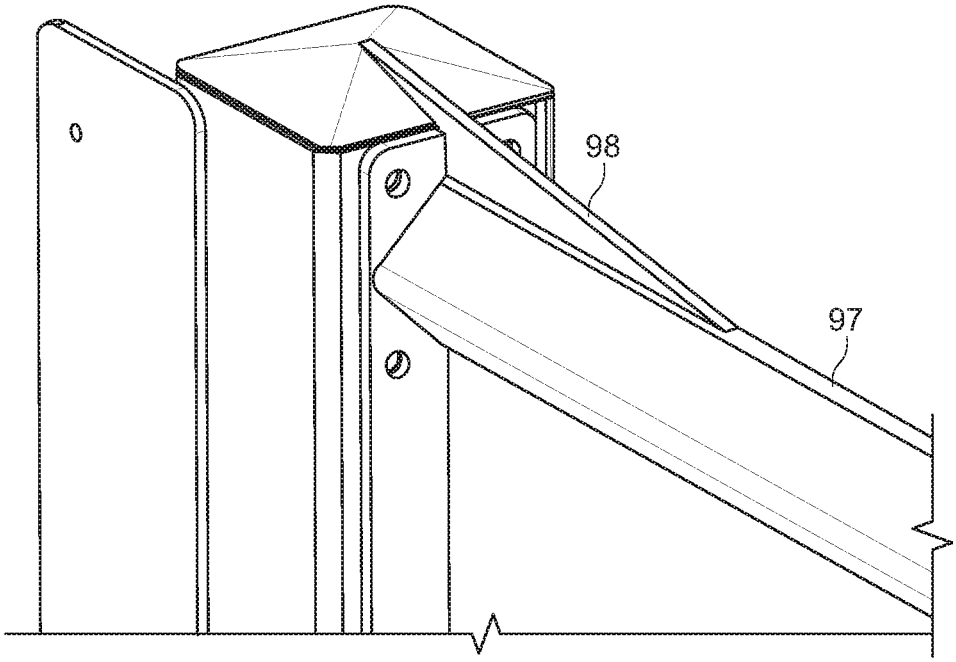
FIG. 33 shows a perspective from above of an upper end portion of a modesty panel assembly, as appears in at least one embodiment of the inventive technology.
Figure 34:
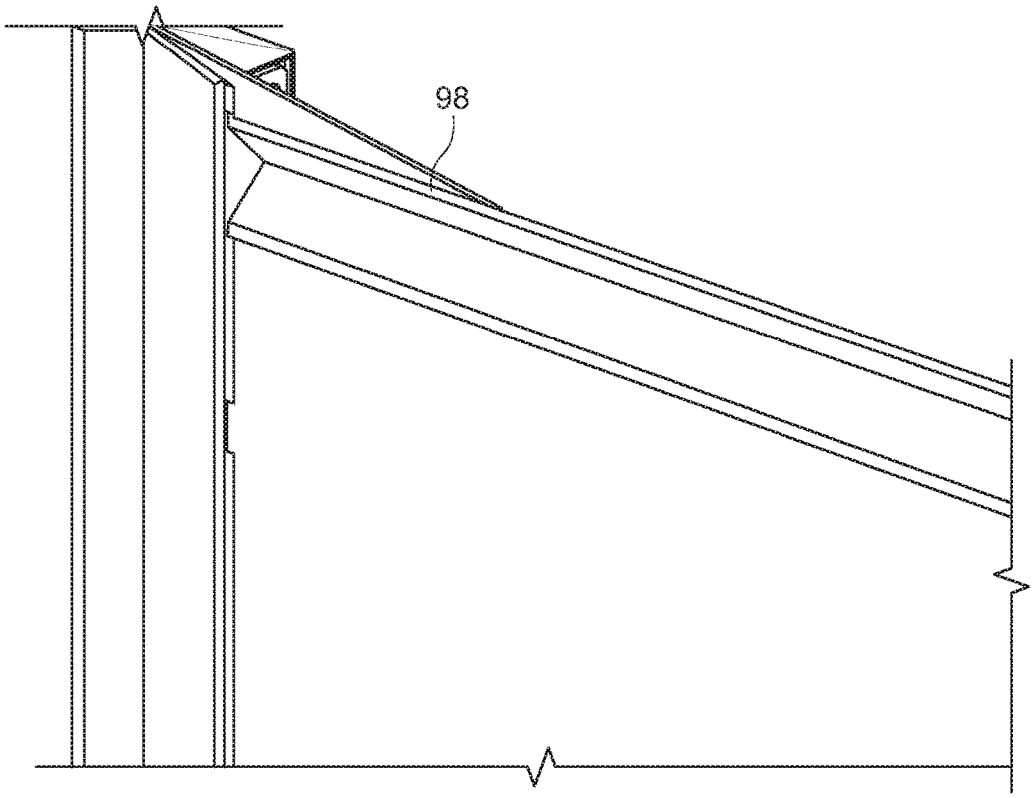
FIG. 34 shows a perspective from above of an upper end portion of a modesty panel assembly, as appears in at least one embodiment of the inventive technology.
Figure 35:
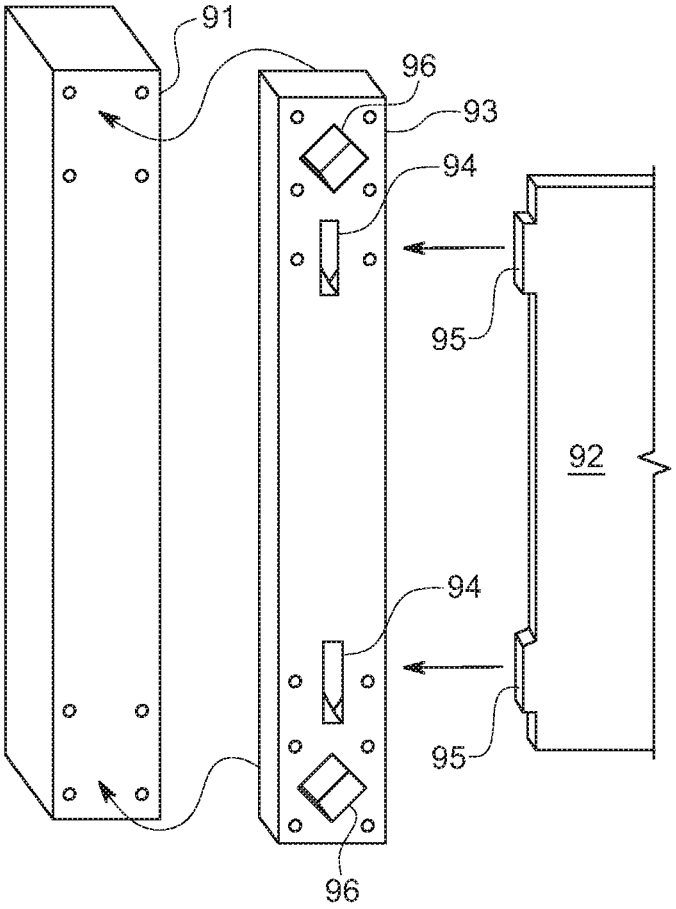
FIG. 35 shows an exploded view of the connection of panel to end plate to post, of a modesty panel assembly, as appears in at least one embodiment of the inventive technology.
Figure 36:
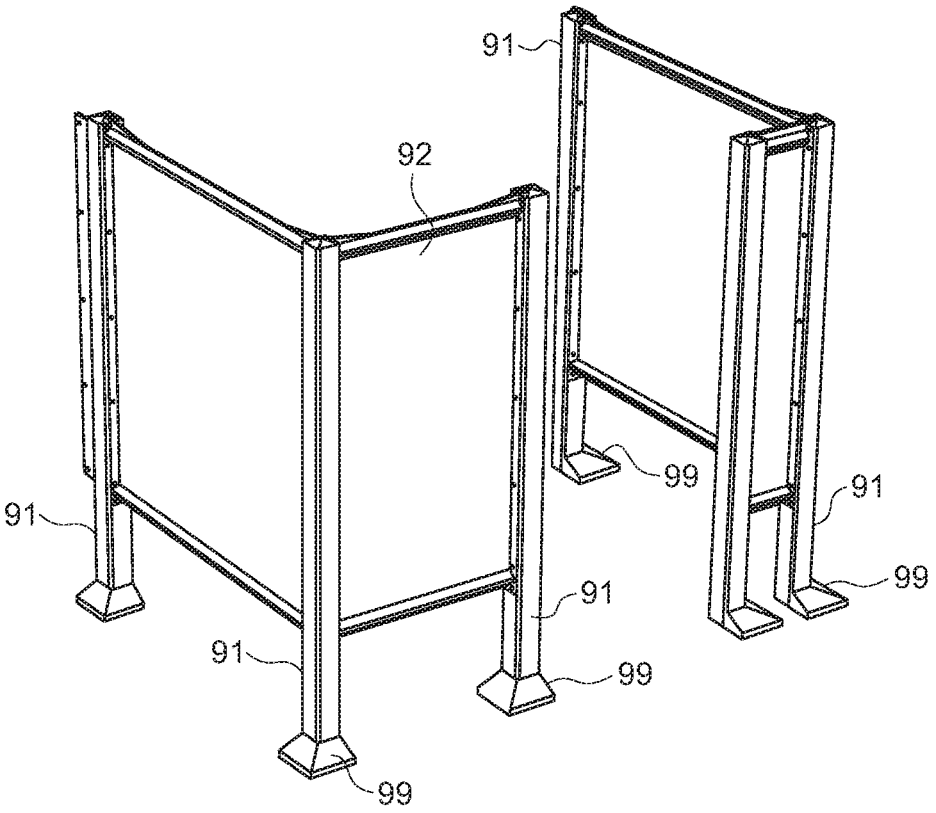
FIG. 36 shows a perspective view of a modesty panel assembly, as appears in at least one embodiment of the inventive technology.

Note that some designs may save costs by not having an outer stall wall panel, or including one only along vertical right and left edges of the stall wall (see FIGS. 15, 17). Instead of such panel, a stall wall may simply have an outer surface of foam.

The stall's connection to the facility walls (e.g., concrete walls, whether or not they pre-exist or are built specifically to serve as structural support for the stall), as mentioned, may be achieved via an engagement of an outer leg 66 of a purlin (e.g., a structural purlin) established between panels of a stall wall with a purlin prong 68 of a purlin connector 70 attached (e.g., via bolting) to a facility wall (e.g., a prison wall). Stall securement via purlin engagement may be achieved by dropping a wall or an entire stall into place from high enough above the stall's final installation position to engage purlins as desired (perhaps only a few inches is high enough). Such drop-in type installation may facilitate and speed the installation (and removal where necessary) process. Note that it is not the case that every stall will be attached to three facility walls. For example, where stalls are placed side by side, a left and/or right stall wall may be attached to another stall wall (whether via purlin engagement, bolting or otherwise). Also, there may only be one or two facility walls to which the stall can be secured (e.g., via purlin engagement).

The walls of a single stall may be attached to one another in any of several ways (e.g., bolting, adhesive, silicone, and/or welding, as but a few examples). One way is shown in FIG. 15. Welds may be used to seal (e.g., prevent the passage of water outside of the space substantially defined by the interior panels of the shower stall (and any curtain or door that may exist). For example, there may be a vertical weld 75 at the interior joint of two abutting walls that are secured to one another. Connections that result in "L"-shaped connections of one stall wall to another may be made before or after any foam installation against the interior panel of the stall wall; where it is made after, some material removal (e.g., foam debridement) may be necessary to enable such bolting operation (or indeed the foam may be manufactured (e.g., via molding) to allow for such bolting. Where a facility wall that is substantially flush with the stall opening the stall may include vertical overlap panels 74 (far left or far right) that may overlap, to some extent that wall as shown in FIG. 15. Such overlap may be in the form of flanges (generally thinner than the stall walls), or may be of similar construction as the stall walls (thicker than flanges), as shown in FIG. 15. The purpose of the overlap may be, e.g., giving the stall a "finished" (as opposed to "raw"), clean appearance, further help to prevent intrusion of water behind the stall, etc. Where such overlap terminates, and particularly when the overlap's construction is similar to that of the stall walls, the overlap's outer panel (e.g., a substantially vertical strip) may protrude out from the wall to some degree, and there may be foam behind such outer panel, although because such overlap may be substantially non-structural, there need not be purlins behind such outer panel. Such protrusion is not necessary, however, and thinner flanges may be used.

Figure 13:
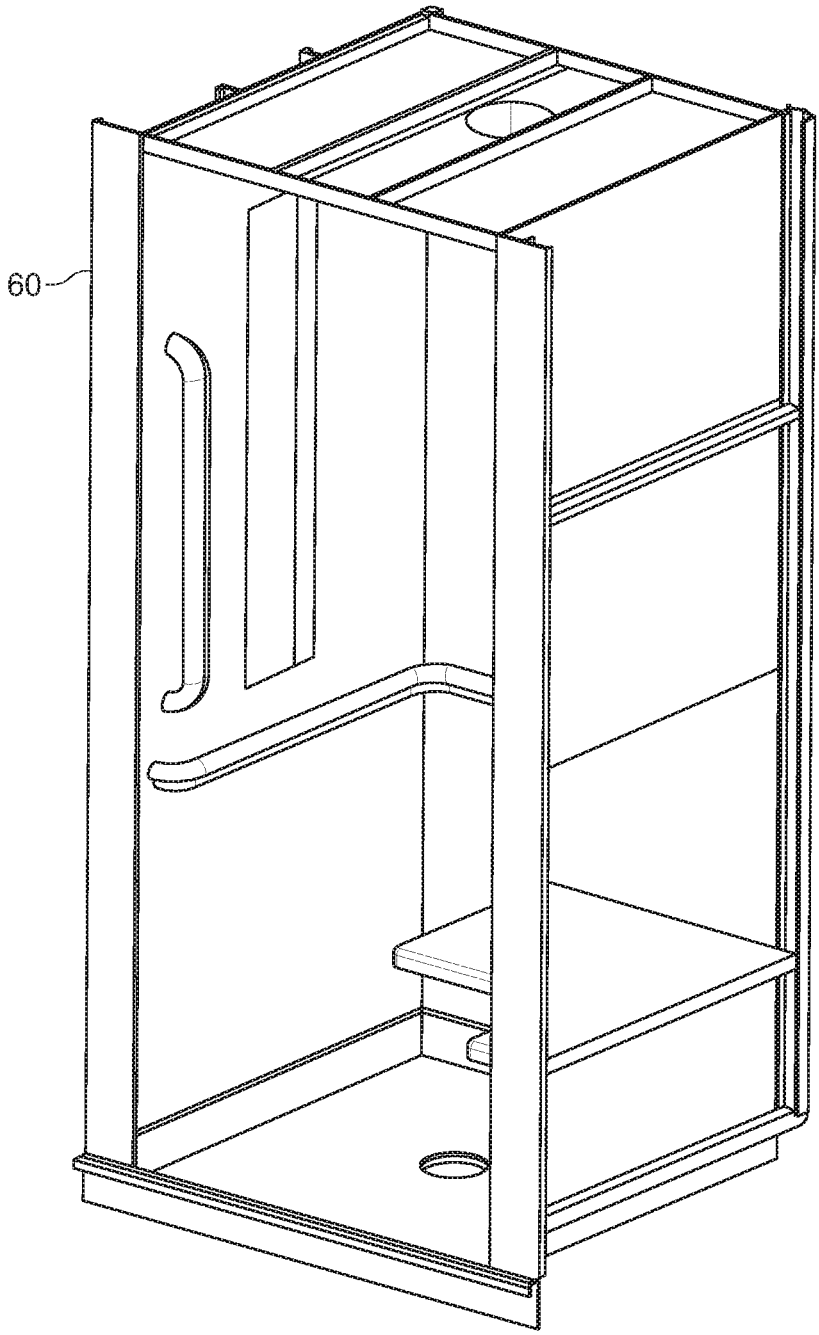
FIG. 13 shows a perspective view of a shower stall, with installed anti-ligature rails, as appears in at least one embodiment of the inventive technology.
Figure 14:
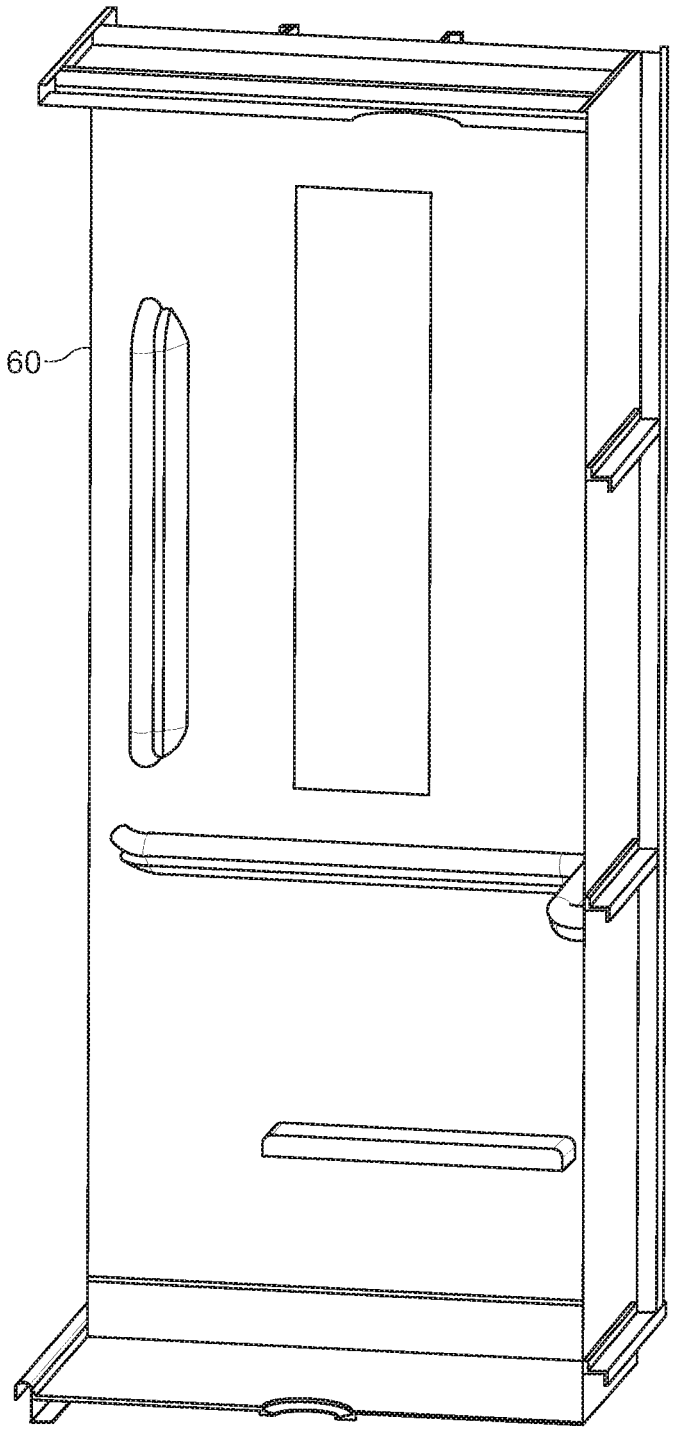
FIG. 14 shows a cut-away view of a shower stall, with installed anti-ligature rails, as appears in at least one embodiment of the inventive technology.

The shower stall assembly may feature the inventive grab rails, as shown in FIGS. 13, 14.

Modesty (Privacy) Panel Assembly:

An aspect of the inventive technology may be an improved modesty (privacy) panel assembly 90, which may, in certain embodiments, appear generally as shown in FIGS. 33-36. The assembly may include posts 91, panels 92, and end plates 93. The end plates, in an assembled, installed configuration, may be established between the posts and the panels. An end plate may have tab ports 94 that are shaped to allow the insertion of corresponding protrusions 95 at a right or left end of a panel. The end plate may be thicker than the distance the protrusions protrude in a left or right direction, such that such protrusions, when established in the corresponding ports of an end plate, do not protrude out of the side of the end plate that is established against the post. After such insertion/interlocking, the protrusions may be welded (e.g., spot welded) into place, thereby securing the end plate to the ends of the panel in a "T" configuration. At some point, whether before or after such insertion and/or welding, the end plate is secured to the post (e.g., via bolting and/or welding). However, where it is desired to weld the inserted tabs in place via a weld on the side of the end plate that interfaces the post, such end plate to post securement is performed after such welding. After the end plates are secured to the wall panel, that assembly may be referred to as a completed wall panel unit. Note that the end plate may also have (in addition to tab ports and bolt holes), a rail port(s) 96 for the insertion (and possibly welding in place) of horizontal rail(s) 97 that may be travel above and possibly also one below the panel (perhaps forming an upper, and lower, border of such panel). The post may be drilled and tapped to receive the end plate (and the panel secured to it).

When viewed in cross-section, in installed configuration, each such rail 97 may be diamond in cross-section, such as square tubing turned on a diamond (or have other shape that does not have horizontal surface anywhere, thereby preventing the setting of objects on that surface, and making it harder to gain any footing on the rail). Each rail, in installed configuration, may also be anti-ligature in that it may be situated relative to the upper (or lower) horizontal end of the panel such that there is no gap between it and such upper or lower horizontal end. In such manner, the rail may be considered a part of the panel and form an upper and possibly lower edge of the panel. Other features of the panel may be anti-ligature fin plates 98 at the top of the upper rail in the vicinity of where the rail connects with a post (such fin plates may make it harder for anything to be wrapped around the portion of the post that protrudes above the rail). Fin plates may be attached in a variety of ways, including but not limited to welding; integrated as part of the rail or post, etc. The modesty panels may be modular, reconfigurable, shipped flat (perhaps as may also be the shower stall and its walls), durable, sleek looking, and/or assembled on site. Further, base plates 99 at the bottom of each post may partially cover the post's interface with the floor. They may be established on the exterior of the assembled panels, and, possibly, the interior thereof.

Note that certain apparatus/structure disclosed herein can be combined with any one or more apparatus/structure disclosed herein. As but two examples: the inventive modesty panel assembly can be used in front of an inventive shower stall; and the inventive grab rails can be used in a shower stall that features the inventive drain adaptor ring.

As can be easily understood from the foregoing, the basic concepts of the present invention may be embodied in a variety of ways. It involves both shower design and installation techniques as well as devices to accomplish the appropriate design and installation. In this application, the design and installation techniques are disclosed as part of the results shown to be achieved by the various devices described and as steps which are inherent to utilization. They are simply the natural result of utilizing the devices as intended and described. In addition, while some devices are disclosed, it should be understood that these not only accomplish certain methods but also can be varied in a number of ways. Importantly, as to all of the foregoing, all of these facets should be understood to be encompassed by this disclosure.

The discussion included in this provisional application is intended to serve as a basic description. The reader should be aware that the specific discussion may not explicitly describe all embodiments possible; many alternatives are implicit. It also may not fully explain the generic nature of the invention and may not explicitly show how each feature or element can actually be representative of a broader function or of a great variety of alternative or equivalent elements. Again, these are implicitly included in this disclosure. Where the invention is described in device-oriented terminology, each element of the device implicitly performs a function. Apparatus claims may not only be included for the device described, but also method or process claims may be included to address the functions the invention and each element performs. Neither the description nor the terminology is intended to limit the scope of the claims that will be included in any subsequent patent application.

It should also be understood that a variety of changes may be made without departing from the essence of the invention. Such changes are also implicitly included in the description. They still fall within the scope of this invention. A broad disclosure encompassing both the explicit embodiment(s) shown, the great variety of implicit alternative embodiments, and the broad methods or processes and the like are encompassed by this disclosure and may be relied upon when drafting the claims for any subsequent patent application. It should be understood that such language changes and broader or more detailed claiming may be accomplished at a later date (such as by any required deadline) or in the event the applicant subsequently seeks a patent filing based on this filing. With this understanding, the reader should be aware that this disclosure is to be understood to support any subsequently filed patent application that may seek examination of as broad a base of claims as deemed within the applicant's right and may be designed to yield a patent covering numerous aspects of the invention both independently and as an overall system.

Further, each of the various elements of the invention and claims may also be achieved in a variety of manners. Additionally, when used or implied, an element is to be understood as encompassing individual as well as plural structures that may or may not be physically connected. This disclosure should be understood to encompass each such variation, be it a variation of an embodiment of any apparatus embodiment, a method or process embodiment, or even merely a variation of any element of these. Particularly, it should be understood that as the disclosure relates to elements of the invention, the words for each element may be expressed by equivalent apparatus terms or method terms—even if only the function or result is the same. Such equivalent, broader, or even more generic terms should be considered to be encompassed in the description of each element or action. Such terms can be substituted where desired to make explicit the implicitly broad coverage to which this invention is entitled. As but one example, it should be understood that all actions may be expressed as a means for taking that action or as an element which causes that action. Similarly, each physical element disclosed should be understood to encompass a disclosure of the action which that physical element facilitates. Regarding this last aspect, as but one example, the disclosure of a "support" should be understood to encompass disclosure of the act of "supporting"—whether explicitly discussed or not—and, conversely, were there effectively disclosure of the act of "supporting", such a disclosure should be understood to encompass disclosure of a "support" and even a "means for supporting" Such changes and alternative terms are to be understood to be explicitly included in the description. Further, each such means (whether explicitly so described or not) should be understood as encompassing all elements that can perform the given function, and all descriptions of elements that perform a described function should be understood as a non-limiting example of means for performing that function.

Any patents, publications, or other references mentioned in this application for patent are hereby incorporated by reference. Any priority case(s) claimed by this application is hereby appended and hereby incorporated by reference. In addition, as to each term used it should be understood that unless its utilization in this application is inconsistent with a broadly supporting interpretation, common dictionary definitions should be understood as incorporated for each term and all definitions, alternative terms, and synonyms such as contained in the Random House Webster's Unabridged Dictionary, second edition are hereby incorporated by reference. Finally, all references listed in the list of References To Be Incorporated By Reference In Accordance With The Provisional Patent Application or other information statement filed with the application are hereby appended and hereby incorporated by reference, however, as to each of the above, to the extent that such information or statements incorporated by reference might be considered inconsistent with the patenting of this/these invention(s) such statements are expressly not to be considered as made by the applicant(s).

Thus, the applicant(s) should be understood to have support to claim and make a statement of invention to at least: i) each of the design and installation devices as herein disclosed and described, ii) the related methods disclosed and described, iii) similar, equivalent, and even implicit variations of each of these devices and methods, iv) those alternative designs which accomplish each of the functions shown as are disclosed and described, v) those alternative designs and methods which accomplish each of the functions shown as are implicit to accomplish that which is disclosed and described, vi) each feature, component, and step shown as separate and independent inventions, vii) the applications enhanced by the various systems or components disclosed, viii) the resulting products produced by such systems or components, ix) each system, method, and element shown or described as now applied to any specific field or devices mentioned, x) methods and apparatuses substantially as described hereinbefore and with reference to any of the accompanying examples, xi) an apparatus for performing the methods described herein comprising means for performing the steps, xii) the various combinations and permutations of each of the elements disclosed, xiii) each potentially dependent claim or concept as a dependency on each and every one of the independent claims or concepts presented, and xiv) all inventions described herein.

With regard to claims whether now or later presented for examination, it should be understood that for practical reasons and so as to avoid great expansion of the examination burden, the applicant may at any time present only initial claims or perhaps only initial claims with only initial dependencies. The office and any third persons interested in potential scope of this or subsequent applications should understand that broader claims may be presented at a later date in this case, in a case claiming the benefit of this case, or in any continuation in spite of any preliminary amendments, other amendments, claim language, or arguments presented, thus throughout the pendency of any case there is no intention to disclaim or surrender any potential subject matter. It should be understood that if or when broader claims are presented, such may require that any relevant prior art that may have been considered at any prior time may need to be re-visited since it is possible that to the extent any amendments, claim language, or arguments presented in this or any subsequent application are considered as made to avoid such prior art, such reasons may be eliminated by later presented claims or the like. Both the examiner and any person otherwise interested in existing or later potential coverage, or considering if there has at any time been any possibility of an indication of disclaimer or surrender of potential coverage, should be aware that no such surrender or disclaimer is ever intended or ever exists in this or any subsequent application. Limitations such as arose in *Hakim v. Cannon Avent Group, PLC,* 479 F.3d 1313 (Fed. Cir 2007), or the like are expressly not intended in this or any subsequent related matter. In addition, support should be understood to exist to the degree required under new matter laws—including but not limited to European Patent Convention Article 123(2) and United States Patent Law 35 USC 132 or other such laws—to permit the addition of any of the various dependencies or other elements presented under one independent claim or concept as dependencies or elements under any other independent claim or concept. In drafting any claims at any time whether in this application or in any subsequent application, it should also be understood that the applicant has intended to capture as full and broad a scope of coverage as legally available. To the extent that insubstantial substitutes are made, to the extent that the applicant did not in fact draft any claim so as to literally encompass any particular embodiment, and to the extent otherwise applicable, the applicant should not be understood to have in any way intended to or actually relinquished such coverage as the applicant simply may not have been able to anticipate all eventualities; one skilled in the art, should not be reasonably expected to have drafted a claim that would have literally encompassed such alternative embodiments.

Further, if or when used, the use of the transitional phrase "comprising" is used to maintain the "open-end" claims herein, according to traditional claim interpretation. Thus, unless the context requires otherwise, it should be understood that the term "comprise" or variations such as "comprises" or "comprising", are intended to imply the inclusion of a stated element or step or group of elements or steps but not the exclusion of any other element or step or group of elements or steps. Such terms should be interpreted in their most expansive form so as to afford the applicant the broadest coverage legally permissible. The use of the phrase, "or any other claim" is used to provide support for any claim to be dependent on any other claim, such as another dependent claim, another independent claim, a previously listed claim, a subsequently listed claim, and the like. As one clarifying example, if a claim were dependent "on claim 20 or any other claim" or the like, it could be re-drafted as dependent on claim 1, claim 15, or even claim 25 (if such were to exist) if desired and still fall with the disclosure. It should be understood that this phrase also provides support for any combination of elements in the claims and even incorporates any desired proper antecedent basis for certain claim combinations such as with combinations of method, apparatus, process, and the like claims.

Finally, any claims set forth at any time are hereby incorporated by reference as part of this description of the invention, and the applicant expressly reserves the right to use all of or a portion of such incorporated content of such claims as additional description to support any of or all of the claims or any element or component thereof, and the applicant further expressly reserves the right to move any portion of or all of the incorporated content of such claims or any element or component thereof from the description into the claims or vice-versa as necessary to define the matter for which protection is sought by this application or by any subsequent continuation, division, or continuation-in-part application thereof, or to obtain any benefit of, reduction in fees pursuant to, or to comply with the patent laws, rules, or regulations of any country or treaty, and such content incorporated by reference shall survive during the entire pendency of this application including any subsequent continuation, division, or continuation-in-part application thereof or any reissue or extension thereon.

What is claimed is:

1. A shower system, comprising:

a shower stall that itself comprises:

a shower pan;

a right, left and rear stall wall established above said shower pan, each of said walls comprising:

an inner stall panel and an outer stall surface;

at least one purlin established between said inner stall panel and said outer stall surface, wherein said at least one purlin having an outer exposed leg that is shaped so that, when said shower stall is lowered from above during a shower installation, said outer exposed leg slidingly engages a prong of a purlin connector that is secured to a facility wall at a height that operatively corresponds to a height of said at least one purlin; and foam established outside of said inner stall panel; and an anti-ligature grab rail system comprising:

a grab rail; and a sheet-type grab rail support that is attached via weld to said grab rail along at least a portion of said grab rail via a radial interface; and a shower drain adaptor ring established around a drain hole through said shower pan, said shower drain adaptor ring comprising:

an angled ramp that is angled to match a corresponding surface of a drain against which said shower adaptor ring is established in final installed shower configuration;

a vertically protruding annulus above said angled ramp and having a lower outer portion;

a shelf established radially outside of said lower outer portion;

an outer wall below said shelf; and a lower surface radially inward of said outer wall.

2. A shower system as described in claim 1 wherein, when said shower stall is in said final installed shower configuration, putty is established between said drain and said angled ramp.

3. A shower system as described in claim 1 where said outer stall surface is an outer surface of said foam.

4. A shower system as described in claim 1 further comprising an outer stall panel, and wherein said outer stall surface is an outer stall panel.

* * * * *